US006547856B2

(12) United States Patent
Cartellone

(10) Patent No.: US 6,547,856 B2
(45) **Date of Patent: *Apr. 15, 2003**

(54) FILTER SYSTEM

(75) Inventor: Mark A. Cartellone, Broadview Heights, OH (US)

(73) Assignee: HMI Industries, Inc., Seven Hills, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/196,860

(22) Filed: Jul. 17, 2002

(65) Prior Publication Data

US 2002/0170432 A1 Nov. 21, 2002

Related U.S. Application Data

(63) Continuation of application No. 09/809,841, filed on Mar. 19, 2001, now Pat. No. 6,488,744.

(51) Int. Cl.[7] ..... B01D 50/00; B01D 45/12; B01D 29/15; B01D 35/30

(52) U.S. Cl. ..... 95/268; 95/287; 55/337; 55/379; 55/414; 55/472; 55/486; 55/492; 55/521; 55/DIG. 3

(58) Field of Search ..... 55/467, 472, 473, 55/379, 486, 492, 498, 521, 524, 413, DIG. 3, 337; 95/268, 287; 15/353

(56) References Cited

U.S. PATENT DOCUMENTS

| | | | |
|---|---|---|---|
| 1,921,085 | A | 8/1933 | Korittke |
| 2,033,833 | A | 3/1936 | Kent |
| 2,139,736 | A | 12/1938 | Durham |
| 2,242,278 | A | 5/1941 | Yonkers, Jr. |
| 2,394,923 | A | 2/1946 | Little |
| 2,532,264 | A | 11/1950 | Smith |
| 2,608,268 | A | 8/1952 | Gerber |
| 2,627,936 | A | 2/1953 | Martinet |
| 2,627,937 | A | 2/1953 | Martinet |
| 2,763,886 | A | 9/1956 | Brown, Jr. et al. |
| 2,814,357 | A | 11/1957 | Bowman |
| 3,343,344 | A | 9/1967 | Fairaizl et al. |
| 3,545,181 | A | 12/1970 | Young |
| 3,724,181 | A | 4/1973 | Benson, Jr. |
| 3,804,942 | A | 4/1974 | Kato et al. |
| 3,853,512 | A | 12/1974 | Hayashi |
| 3,870,495 | A | 3/1975 | Dixson et al. |
| 3,925,043 | A | 12/1975 | Matrone et al. |
| 3,953,184 | A | 4/1976 | Stockford et al. |
| 3,966,597 | A | 6/1976 | Omori et al. |

(List continued on next page.)

FOREIGN PATENT DOCUMENTS

| | | |
|---|---|---|
| DE | 27 11 111 A1 | 9/1979 |
| DE | 42 40 172 A1 | 6/1994 |
| FR | 2 653 354 A1 | 4/1991 |
| JP | 2-187114 A2 | 7/1990 |
| JP | 4-197460 A2 | 7/1992 |
| JP | 8-66341 A2 | 3/1996 |
| JP | 11-309204 | 11/1999 |

OTHER PUBLICATIONS

Article entitled *3M Brand Substrate Blown Microfiber Filter Media*, from brochure entitled *3M Filtration Products*, 1994.

*Primary Examiner*—Robert A. Hopkins
(74) *Attorney, Agent, or Firm*—Fay, Sharpe, Fagan, Minnich & McKee

(57) ABSTRACT

A vacuum cleaner having a reduced velocity chamber with a high velocity air inlet, an electric motor, a rotary blade driven by the motor to create a vacuum in the chamber, an outlet for exhausting air from the chamber, which air flows in a selected path from the air inlet, through the chamber and out the air exhaust outlet and a disposable porous sheet filter layer in the chamber for removing large solid particles from the air.

70 Claims, 12 Drawing Sheets

U.S. PATENT DOCUMENTS 3,998,916 A 12/1976 van Turnhout
4,121,916 A 10/1978 Fricke
4,229,193 A 10/1980 Miller
4,339,250 A 7/1982 Thut
4,365,980 A 12/1982 Culbert et al.
4,377,399 A 3/1983 Bryson
4,378,234 A 3/1983 Suzuki et al.
4,385,911 A 5/1983 Popeil et al.
4,477,270 A 10/1984 Tauch
4,504,290 A 3/1985 Pontius
4,507,819 A 4/1985 Martinec
4,514,197 A 4/1985 Armbruster
4,531,956 A 7/1985 Howorth
4,627,862 A 12/1986 Frei et al.
4,629,482 A 12/1986 Davis
4,650,505 A 3/1987 Magdelain
4,687,579 A 8/1987 Bergman
4,687,697 A 8/1987 Cambo et al.
4,702,753 A 10/1987 Kowalczyk
4,737,173 A 4/1988 Kudirka et al.
4,749,390 A 6/1988 Burnett et al.
4,750,924 A 6/1988 Potter
4,784,676 A 11/1988 Hale
4,810,269 A 3/1989 Stackhouse et al.
4,874,659 A 10/1989 Ando et al.
4,886,527 A 12/1989 Föttinger et al.
4,900,344 A 2/1990 Lansing
4,902,306 A 2/1990 Burnett et al.
4,909,815 A 3/1990 Meyer
4,917,942 A 4/1990 Winters
4,921,510 A 5/1990 Plooy
4,927,437 A 5/1990 Richerson
5,037,455 A 8/1991 Scheineson et al.
5,108,470 A 4/1992 Pick
5,141,706 A 8/1992 Clark
5,188,646 A 2/1993 Nolen, Jr.
5,221,573 A 6/1993 Baigas, Jr.
5,240,478 A 8/1993 Messina
5,248,323 A 9/1993 Stevenson
5,287,591 A 2/1994 Rench et al.
5,288,298 A 2/1994 Aston
5,290,330 A 3/1994 Tepper et al.
5,306,534 A 4/1994 Bosses
5,307,538 A 5/1994 Rench et al.
5,350,620 A 9/1994 Sundet et al.
5,358,443 A 10/1994 Mitchell et al.
5,399,319 A 3/1995 Schoenberger et al.
5,435,817 A 7/1995 Davis et al.
5,443,625 A 8/1995 Schaffhausen
5,478,377 A 12/1995 Scavnicky et al.
5,498,272 A 3/1996 Leon
5,515,573 A 5/1996 Frey
5,593,479 A 1/1997 Frey et al.
5,603,741 A 2/1997 Frey
5,641,343 A 6/1997 Frey
5,647,881 A 7/1997 Zhang et al.
5,651,811 A 7/1997 Frey et al.
5,658,362 A 8/1997 Frey
5,807,415 A * 9/1998 Leo ..... 206/223
5,837,020 A 11/1998 Cartellone
5,840,103 A 11/1998 Dyson
5,874,052 A 2/1999 Holland
5,931,991 A 8/1999 Leon
6,003,196 A 12/1999 Wright et al.
6,010,550 A 1/2000 Song
6,090,184 A 7/2000 Cartellone
D432,746 S 10/2000 Frey
6,171,054 B1 1/2001 Mann et al.
6,197,096 B1 3/2001 Cartellone
6,243,915 B1 6/2001 Nakai et al.
6,341,404 B1 1/2002 Salo et al.

* cited by examiner

FILTER SYSTEM

This patent application is a continuation of U.S. application Ser. No. 09/809,841, filed on Mar. 19, 2001, now U.S. Pat. No. 6,488,744, and incorporated herein by reference.

The present invention relates to the art of air filter systems and, more particularly, to an improved vacuum cleaner employing a novel filter system. The invention is particularly applicable for a canister type vacuum cleaner and it will be described with particular reference thereto; however, the invention has much broader applications and may be used to filter air by employing the novel filter system and filtering method as contemplated by the present invention.

INCORPORATION BY REFERENCE

U.S. Pat. Nos. 5,248,323; 5,515,573; 5,593,479; 5,603,741; 5,641,343; 5,651,811; 5,658,362; 5,837,020; 6,090,184; and Des. No. 432,746 are incorporated herein as background information regarding the type of cleaning systems to which the present invention is particularly applicable, and to preclude the necessity of repeating structural details relating to such cleaning systems. Several of these patents illustrate a canister type vacuum cleaner with a low velocity receptacle or chamber into which is placed a conical filter sheet formed from non-woven cellulose fiber placed over a downwardly extending support structure for the purpose of removing particulate material from the air flowing through the vacuum cleaner. The rigid perforated conical support structure or member holds the filter sheet in its conical configuration. The support member and filter sheet are mounted together with the layer covering the rigid support member. Within the conical support member there is provided a generally flat disc shaped cellulose filter sheet for further removal of particulate solids as the solids pass with the air from the canister through the conical filter sheet and through the disc to the outlet or exhaust of the vacuum cleaner.

BACKGROUND OF THE INVENTION

As more people populate urban environments, there is an increasing need to provide a clean air environment at home and in the work place. In urban areas, where pollution levels sometimes exceed maximum values set by the EPA, the need for a clean air environment becomes even more apparent. In view of the posed hazards these polluted environments create, the public has demanded a means for removing pollutants from the environment to provide a healthy environment for both living and working. Furthermore, many particles in the air can act as irritants and/or increase or aggravate a person's allergies. Airborne pollutants can also contribute to respiratory infections and illnesses which can be hazardous to individuals with respiratory problems. Particles in the air can also create problems such as burning eyes, nose and throat irritation; cause or contribute to headaches and dizziness, and/or cause and/or contribute to coughing and sneezing. Furthermore, these particles can include various types of spores, dust mites, micro-organisms, such as bacteria and/or viruses, and/or other types of harmful particles which may cause serious illness or infection to a person.

In an effort to reduce the number of particles from the air and/or other environments, many homes, offices, and buildings have incorporated a central filtering system to remove particles entrained in the air. Unfortunately, these systems are very expensive and/or do not remove many of the small particles which can be the most hazardous and irritable to persons, such as spores, micro-organisms, such as bacteria and/or viruses, dust mites and some harmful chemicals. Typically, these filtering systems only remove about 300,000 particles out of about 20 million particles which flow into the filter medium. The small particles, which make up a majority of the particles in the air, freely pass through these conventional filter systems and are recirculated through the home and/or office.

In an effort to remove particles from a home and/or office environment, and reduce the amount of particles recirculated during the vacuuming of the home and/or office, two design strategies have been developed by Assignee, one relating to the design of the vacuum cleaner and the second relating to the design of the filters. Assignee has found that canister type vacuum cleaners provide superior cleaning efficiencies as compared with upright vacuum cleaners. One particular canister type vacuum cleaner is illustrated in U.S. Pat. No. 5,248,323, which is incorporated herein by reference. The canister type vacuum cleaner includes a reduced or low velocity chamber with a high velocity air inlet. Air is drawn into the low velocity chamber by an electric motor which drives a rotary fan. The rotary fan creates a vacuum in the low velocity chamber to draw air laden with particulate material through the chamber and to blow the filtered air through an outlet in the motor housing as exhausted clean air. Canister type vacuum cleaners normally include a cylindrical or a conical cellulose filter extending downwardly into the canister or low velocity chamber. The filter is typically formed of a porous mat to remove dirt and debris carried by the air drawing into the low velocity chamber. The high velocity air drawn into the chamber has entrained large solid particles. The large particles which are brought into the low velocity chamber are swirled or vortexed in a centrifuge configuration with convolutions so that the large particles are extracted by the vortexed or cyclonic action of the air in the canister. Thereafter, the air is pulled through the filter toward an upper motor that drives a fan which creates a vacuum in the canister or low velocity chamber. The fan then expels the filtered air outwardly through an exhaust passage, or passages, above the canister. A filter, such as a thin filter disc, is provided between the conical filter and the fan to prevent large particulate material that is inadvertently passed through the cylindrical or conical filter from contacting the fan. The '323 patent discloses the use of an activated charcoal containing filter to efficiently remove gaseous impurities in the air, such as paint fumes and other odor creating gases.

The canister type vacuum cleaner, as so far described, though exhibiting improved cleaning efficiencies as compared with upright vacuum cleaners, only removes relatively large particles entrained in the air. Many of the air particles of a size less than 10 microns pass freely through the filter medium and are recirculated in the room. These small particles can act as irritants to an individual and the recirculation of such particles can increase such irritation to an individual. High density filters can be used to filter out these very small particles in the air; however, high density filters cause large pressure drops through the filter and thus cannot be cost effectively used in standard vacuum cleaners.

The filter system disclosed in U.S. Pat. Nos. 5,593,479 and 5,651,811 addresses the problem of filtering small particles by disclosing a multi-layer filter which includes at least one layer of electrically charged fiber material encapsulated between at least two layers of support material. The multi-layer filter effectively removes small particles from the air which penetrate the cellulose fiber layer. The multi-layer filter is a specialized filter developed to remove many of the small particles in the air. Such filters are known as HEPA filters, High Efficiency Particle Air Filters, which, by government standards, are filters with a minimum efficiency of 99.97%. The industry defines HEPA filters as those which are efficient in removing 99.97% of the airborne particles having the size of 0.3 micron or larger. HEPA filters are commonly used in ultra clean environments such as in a laboratory, in electronic and biologically clean rooms, in hospitals, and the like. HEPA filters have recently been incorporated in air filters for business and individual use. The '479 and '811 patents disclose that an activated charcoal filter can also be used to remove odors from the air.

The multiple filter system disclosed in the '479 and '811 patents was further improved by the filter system disclosed in U.S. Pat. No. 6,090,184. The filter system disclosed in the '184 patent combined an electrically charged fiber material with an activated charcoal filter to simplify the use of the filters in the vacuum cleaner. The combined filter reduced the number of filters to only the standard cellulose filter and the combined gas and small particle filter. The combined filter was designed to exhibit increased filter efficiency without added pressure drop. The efficiencies of standard HEPA filters are all based upon 0.3 micron size particles. Historically, it was believed that particles about 0.3 micron in size were the most difficult to remove from the air. However, particle filtration testing revealed that particles the size of about 0.1 micron are the most difficult to remove from the air. Standard HEPA filters do not efficiently remove such small particles and allow such particles to freely pass through the filter medium. An analysis of these small particles has shown that the particles do not naturally fall out of the air, but instead remain entrained in the air by constantly bouncing off other particles in the air (i.e. Browning effect). These small particles have also been found to deviate from the air flow thus making such particles even more difficult to remove from the air. The filter disclosed in the '184 patent was designed to remove at least about 99.98% of the particles in the air that were about 0.1 micron or greater in size.

Although Assignee's vacuum cleaners and filter systems effectively and efficiently remove particles entrained in the air, there is a continued demand for more efficient vacuum cleaners and more user friendly vacuum cleaners.

SUMMARY OF THE INVENTION

The present invention relates to an improved air filtering system and, more particularly, to a vacuum cleaner with a novel filtering system which allows the vacuum cleaner to efficiently and effectively remove particles and/or unwanted odors or gases from the environment. In one embodiment, the improved filtering system is used in a cyclonic type vacuum cleaner such as, but not limited to, a canister type vacuum cleaner, to handle a wide variety of particles entrained in the air being drawn through the vacuum cleaner. In another embodiment, the filtering system is designed to remove odors from the air as the air passes through the filtering system. In essence, the filtering system can be used in an environmental air cleaning device as well as a standard vacuum cleaner.

In accordance with the present invention, there is provided an improvement in a vacuum cleaner of the type comprising a reduced or low velocity chamber with a high velocity air inlet, a motor, a rotary device driven by the motor to create a vacuum in the low velocity chamber, an outlet for exhausting air from the low velocity chamber, and a filtering system positioned at least partially in the low velocity chamber for removing solid particles from the air. In one embodiment, the filtering system includes one or more changeable and/or disposable filters. In one aspect of this embodiment, at least one of the filters removes most sizes of particles including particles of less than about ten microns in size. Such a filter provides a significantly cleaner environment. Standard filter mediums filter out approximately 300,000 particles out of 20 million particles which flow into the filter medium. Particles which are ten microns or less in size pass freely through a standard filter medium. Such particles include pollen, dust mites, bacteria, viruses, etc. The recirculation of these small particles can spread diseases and/or cause allergic reactions. The filtering system of the present invention includes a filter which removes a majority of sizes of particles entrained in the air. In a typical vacuuming operation, nearly 20 million particles are directed into the vacuum cleaner. The filtering system removes at least about 18–19 million of these particles. As a result, over 90% of the particles greater than 2 microns in size are filtered out of the air passing through the improved filtering system. The filtering system can include mechanical, electrical (which includes electrostatics) and/or chemical mechanisms to filter out the particles. In another embodiment, the filtering system is designed to remove odors from the air. In one aspect of this embodiment, the filtering system incorporates the use of a gas absorbing substance to absorb odors that are drawn into the vacuum cleaner.

In accordance with another aspect of the present invention, the filtering system includes one or more particle filters which removes at least about 99.97% of the particles entrained in the air having a size greater than about 0.3 micron. In one embodiment, the particle filter removes at least about 99.98% of the particles entrained in the air having a size greater than about 0.1 micron. In another embodiment, the particle filter is made of one or more filter layers. In aspect of this embodiment, the particle filter is a single filter made of multiple filter layers. In another aspect of this embodiment, the particle filter is a plurality of single layer filters. In still another aspect of this embodiment, the particle filter is a plurality of filters, which filters are single layer filters and/or multiple layer filters. In still another embodiment, the particle filter removes particles from the air mechanically, chemically and/or electrically. In yet another embodiment, the composition of the particle filter includes, but is not limited to, the composition of particle filters disclosed in U.S. Pat. Nos. 5,248,323; 5,593,479; 5,641,343; 5,651,811; 5,837,020 and 6,090,184, which are incorporated herein by reference. In still yet another embodiment, the configuration or design of the particle filter includes, but is not limited to, the configuration or design disclosed in U.S. Pat. Nos. 5,248,323; 5,593,479; 5,641,343; 5,651,811; 5,837,020 and 6,090,184, which are incorporated herein by reference.

In accordance with still another aspect of the present invention, the filtering system includes one or more gas filters to remove undesired gases and/or odors from the filtered air such as, but not limited to, smoke, fumes, gas contaminants, and/or noxious gases. In one embodiment, the gas filter includes a gas absorbing substance. In one aspect of this embodiment, the gas absorbing substance includes, but is not limited to, activated carbon, activated charcoal, diatomaceous earth, Fuller's earth, volcanic rock, lava rock, and/or baking soda. In another embodiment, the gas filter includes one or more mats, or woven and/or non-woven materials impregnated with one or more gas absorbing substances. In one aspect of this embodiment, the average particle size of the gas absorbing substance, when impregnated on and/or in a material, is generally less than about 10 mesh, and typically less than about 100 mesh; however, larger particles can be used. In another aspect of this embodiment, the mat includes a non-woven polyester material. In another aspect of this embodiment, the material has a sponge-like texture. In still another aspect of this embodiment, the material has a thickness of about 0.001–1 inch. In still another aspect of this embodiment, the one or more gas filters also filter particles from the air as the air passes through the gas filter(s). In yet another embodiment, one or more gas filters include one or more gas absorbing substances in the form of a resin and/or granules. In one aspect of this embodiment, the resin and/or granules are contained in an air permeable device such as, but not limited to, a ventilative bag, a ventilative container and/or the like. In still yet another embodiment, the one or more gas filters include one or more gas absorbing substances impregnated in a textile material. In a further embodiment, the gas filter(s) and particle filter(s) are oriented such that at least one particle filter or filter layer filters particles prior to exposing the filtered air to the gas filter(s). In yet a further embodiment, the gas filter(s) and particle filter(s) are oriented such that at least one gas filter or gas filter layer absorbs gas prior to exposing the gas filtered air to the particle filter(s).

In accordance with yet another aspect of the present invention, the filtering system includes a particle filter for removing small particles that includes at least one section designed to be a high efficiency particle removing section to remove very small particles from the air passing through the filter. This section can use mechanical and/or electrical (including electrostatic) capture mechanisms to remove particles entrained in the air. This section can include one or more layers. If more than one layer is used, the layer can be connected together by adhesive, stitching, staples, clamps, melted regions, and/or the like. In one embodiment, the particle filter is pliable so that the section easily conforms to and/or deforms on a surface, such as when the particle filter is subjected to suction. In one aspect of this embodiment, the deformation of the particle filter results in the filter having one or more ribs and one or more recessed sections between the ribs. In another embodiment, the particle filter has a generally conical shape.

In accordance with still another aspect of the present invention, the filtering system includes a gas filter having at least one section for removing odor and gas from the air passing through the filter. This section can use chemical, mechanical and/or electrical (including electrostatic) capture mechanisms to remove odors and/or undesired gas the air. This section can include one or more layers. If more than one layer is used, the layer can be connected together by adhesive, stitching, staples, clamps, melted regions, and/or the like. In one embodiment, the gas filter is pliable so that the section easily conforms to and/or deforms on a surface, such as when the gas filter is subjected to suction. In one aspect of this embodiment, the deformation of the gas filter results in the gas filter having one or more ribs and one or more recessed sections between the ribs. In another embodiment, the gas filter has a generally conical shape.

In accordance with still yet another aspect of the present invention, the filtering system includes a particle/gas filter for removing small particles that includes at least two distinct sections. One section of the particle/gas filter is designed to be a high efficiency particle removing section to remove very small particles from the air passing through the filter. This section uses mechanical and/or electrical (including electrostatic) capture mechanisms to remove particles entrained in the air. This section can include one or more layers. The second section of the particle/gas filter is designed to be a gas removal section to remove unwanted gases from the air. This second section can be designed to also remove particles from the air. The second section uses electrical (including electrostatic), mechanical and/or chemical capture mechanisms to remove gases and/or particles from the air. The second section can be comprised of one or more layers. In one embodiment, the two sections are connected together. In one aspect of this embodiment, at least two of the sections are connected together by adhesive, stitching, staples, clamps, melted regions, and/or the like. In one specific design, at least two of the sections include a hot melt adhesive to at least partially connect the sections together. In another embodiment, one or more of the sections is pliable so that the sections easily conform to and/or deform on a surface, such as when the sections are subject to suction. In still another embodiment, one or more of the sections is rigid or semi-rigid so as to resist being deformed, especially when exposed to suction. The improved particle/gas filter removes small particles and odors in the air as the air passes through the filter, thus eliminating the need for a separate filter for small particle removal and odor removal. The two sections of the particle/gas filter are connected together to maintain the integrity of the sections during operation and to minimize the degree of pressure drop through the filter. In still another embodiment, the orientation of the filter sections is such that the filter section filters particles prior to exposing the filtered air to the gas absorbing substance in another filter section. Alternatively, the orientation of the filter sections is such that the filter section absorbs gas by the gas absorbing substance prior to exposing the filtered air to particle filtration of another filter section. Alternatively, the orientation of the filter sections is such that the filter section absorbs gas by the gas absorbing substance and filters particles at substantially the same time prior to exposing the filtered air to another filter section.

In accordance with a further aspect of the present invention, the filtering system includes a filter that has a support material and fiber material. In one embodiment, the fiber material is an electrically charged material that is adapted to attract particles to the fibers as particle-entrained air pass adjacent the fibers. In one aspect of the embodiment, the fiber material forms at least one filter layer. In another aspect of this embodiment, the fiber material is a non-woven material. In still another aspect of this embodiment, each layer of the fiber material has a weight of about 30–180 $gm/m^2$. In yet another embodiment, the support material is a durable material used to maintain the integrity of the fiber material. In one aspect of this embodiment, the support material at least partially supports and maintains the fiber material in position during the air filtration process. In another aspect of this embodiment, the support material is a woven material such as, but not limited to, cotton, nylon, rayon, and/or polyester. In still another aspect of this embodiment, the support material at least partially encapsulates the fiber material. In another embodiment, the at least one layer of support material and at least one layer of fiber material are connected together by adhesive, stitching, staples, clamps, melted regions, and/or the like.

In accordance with still another aspect of the present invention, a disposable cellulose filter is used to remove large particles entrained in the air. The cellulose filter can be used alone or in combination with one or more other filters. In one embodiment, the cellulose filter is positioned in the air path such that the particle entrained air passes through the cellulose filter prior to the air contacting a filter designed to remove very small particles and/or gas. The use of the cellulose filter enhances the life of the one or more other filters in the filtering system.

In accordance with yet another aspect of the present invention, one or more filters in the filtering system are cylindrical, conical or semi-conical in shape to increase the surface area of the filter(s) thereby providing increased particle removal.

In accordance with still yet another feature of the present invention, the filtering system minimizes the degree of pressure drop as the air passes through the filtering system. The relatively low pressure drop through the filtering system enables the filtering system to be used in vacuum cleaners, such as canister type vacuum cleaners or in various other types of air filter systems. In addition, the lower pressure drop allows the vacuum cleaner to use a smaller motor so that the vacuum cleaner can have a more compact and portable design, utilize less energy, and/or generate less noise.

In accordance with another aspect of the present invention, one or more filters of the filtering system include one or more tabs, loops or the like, to facilitate the ease in which the filter(s) can be positioned in the vacuum cleaner and/or removed from the vacuum cleaner. The tabs, loops, etc., may also be used as an indicator for the proper position of the filter(s) and/or include information about the filter(s).

In accordance with yet a further aspect of the present invention, the motor of the vacuum cleaner is at least partially located within a motor housing to draw air through an air intake and into the low velocity chamber of the vacuum cleaner, through one or more filters of the filtering system, and to expel the filtered air out through the air exhaust. In one embodiment, the motor includes an electric motor which drives a blade that creates a vacuum in the low velocity chamber, which in turn results in air being drawn into the air intake and through the one or more filters of the filtering system. In another embodiment, one or more filters of the filtering system are disposed between the air intake and the low velocity chamber of the vacuum cleaner to remove a wide variety of particles and/or gases in the air.

In accordance with another aspect of the present invention, a support mechanism is employed to maintain one or more of the filters of the filtering system in a proper position in the vacuum cleaner and/or to support the one or more filters during the filtration of the air. The support mechanism can be incorporated into the filters themselves and/or can be an external mechanism such as a frame. The support mechanism can be one or more pieces. In one specific design, the support member is one piece. In another specific design, the support member is two pieces connected together by bolts, screws, clips, lock tabs, and/or the like. The support mechanism is designed to position and/or to support the one or more filters without impairing the air flow through the one or more filters. In one embodiment, the support mechanism includes a support member having a generally cylindrical or conical shape. In one aspect of this embodiment, the outer perimeter of the support member has a profile and shape that is substantially the same as the profile and shape of the surface of at least one filter so as to substantially fully support the filter. In one specific design, the support member is at least partially nested in at least one filter. In another specific design, at least one filter is at least partially nested in the support member. In another aspect of this embodiment, the outer perimeter of the support member has a profile and shape that is smaller than the profile and shape of the surface of the filter so as to cause the filter to at least partially collapse onto the support member when air is drawn through the filter. In one specific design, the support member is nested in at least one filter and the at least one filter at least partially collapses on the support member during the operation of the vacuum cleaner. In another embodiment, the support mechanism includes a support member having a plurality of fin sections. In one aspect of this embodiment, a plurality of the fin sections are spaced apart from one another. In one specific design, the fin sections are generally symmetrically positioned apart from one another. In another aspect of this embodiment, the outer surface of the fin sections forms a generally cylindrically shaped or conically shaped support member. In still another aspect of this embodiment, at least one opening exists between at least two adjacently positioned fin sections. In still another embodiment, the support member includes at least one rigidity arrangement that at least partially extends between at least two adjacently positioned fin sections. In one aspect of this embodiment, the rigidity arrangement includes at least one rigidity panel. The rigidity panel provides structural rigidity to the support member thereby inhibiting or preventing deformation of the support member during operation of the vacuum cleaner. In another aspect of this embodiment, at least one rigidity panel is positioned between all adjacently portioned fin sections. In yet another aspect of this embodiment, at least one rigidity panel is positioned at least closely adjacent to the rim of the support member. In one specific design, one or more of the rigidity panels are at least partially recessed from the outer peripheral edge of the fin sections. In another specific design, one or more rigidity panels are at least partially flush with the outer peripheral edge of the fin sections. In yet another aspect of this embodiment, the rigidity arrangement includes a rim that connects a plurality of fin sections together. The rim provides structural rigidity to the support member thereby inhibiting or preventing deformation of the support member during operation of the vacuum cleaner. In one specific design, the rim connects all the fin sections together. In another specific design, the rim includes a lip to provide ease of handling the support member, increased structural rigidity, and/or improved sealing. In still another aspect of this embodiment, the rigidity arrangement includes at least one rigidity ring. Like the rigidity panel and rim, the rigidity ring provides structural rigidity to the support member thereby inhibiting or preventing deformation of the support member during operation of the vacuum cleaner. In a further aspect of this embodiment, the rigidity ring is positioned between the rim and the base of the support member. In one specific design, the rigidity ring is positioned at or close to the mid point between the base and rim of the support member. In another specific design, at least one rigidity panel extends upwardly from the rigidity ring and toward the rim of the support member. In yet another embodiment, the support mechanism includes a sealing arrangement to inhibit or prevent air from circumventing through one or more filters of the filtering system and support member. Air that enters the vacuum cleaner is drawn through one or more filters of the filtering system and through the support member. Any air that circumvents the one or more filters of the filtering system will not be properly filtered. The sealing arrangement is designed to help ensure that most, if not all, of the air entering the vacuum cleaner is directed through one or more filters of the filtering system and through the support member. In one aspect of this embodiment, the sealing arrangement includes a sealing ring. The sealing ring is typically made of a plastic and/or rubber material; however, other materials can be used. In one specific design, the sealing ring is placed on and/or secured to the rim of the support member. The sealing ring forms a seal between the support member and low velocity chamber of the vacuum cleaner when the support member is inserted into the low velocity chamber. The sealing ring causes air entering the low velocity chamber to pass through the one or more filters of the filtering system that are positioned adjacent the support member.

In accordance with still another aspect of the invention, the filtering system includes at least one filter having a filter profile that reduces the quantity of large particles entering the low velocity chamber of the vacuum cleaner that are being entrapped, caught, or otherwise embedded on at least one of the filters. This reduction in the number of large particles being entrapped on one or more of the filters during the vacuuming process increases the life and efficiency of the filtering system. In one embodiment, at least one of the filters includes a rib and trough profile on the outer peripheral surface of the filter. The rib and trough profile can be a rigid or semi-rigid structure of the filter, or be a result of the deformation of the filter during the vacuuming process. Typically, the surface area of the trough portion of the filter is greater than the surface area of the rib portion of the filter. The one or more ribs are designed to function as a first contact barrier to particles entrained in the air. The larger particles in the air, upon contact with the one or more ribs, are stopped or reduced in velocity by the one or more ribs. The stopping or reduction in velocity of large particles causes the particles to drop out of the entrained air and onto the base of the low velocity air chamber. Due to the relatively small surface area of the rib portion of the filter, the larger particles have less area to stick to, thus fall off. In addition, since the ribs are exposed to the air first, larger particles that have stuck to the ribs are subsequently knocked off by other particles. Consequently, the larger particles are knocked out of the air prior to the air contacting the trough portion of the filter. The reduction of particles in the air results in the filter having a longer life. In another embodiment, the filter having the rib and trough profile is exposed to a circular or cyclonic air stream. This type of air path is typically produced in canister type vacuum cleaners. The circular or cyclonic air stream causes the particle entrained air to contact the side and front of the rib portions of the filter prior to the air contacting the trough portion of the filter since the rib portions extend farther out into the air stream path than the trough portions. In still another embodiment, the filter having the rib and trough profile has a generally cylindrical or conical shape. In yet another embodiment, the support arrangement includes a support member that is nested in at least one filter of the filtering system. The filter can be a particle and/or gas filter. The support member can be nested in more than one filter, such as two or more filters are nested together, and the support member is nested in the two or more nested filters. When one filter is used, typically the filter is a particle filter or includes a particle filtering section. When more than one filter is used, typically at least one of the filters is a particle filter or includes a particle filtering section. The support member typically has a shape and size that is equal to or smaller than the shape and size of the one or more filters being supported. In one aspect of this embodiment, the support member has a smaller shape and size as compared to the filter to be supported. In addition, the support member has a plurality of fins that are spaced apart from one another. This fin structure of the support member results in a flexible filter to deform onto the fin structure when exposed to a vacuum. The fin structure of the support member causes the filter to form ribs, and the spacing between the fins allows the filter to form troughs between the fins.

In accordance with still yet another aspect of the invention, the filtering system includes a safety filter to prevent large particles from entering the motor section of the vacuum cleaner and/or contacting the motor fan. During the operation of the vacuum cleaner, the particle filter may be damaged during use of the vacuum cleaner and/or from improper installation. For instance, large particles such as, but not limited to, glass pieces, nails, tacks, rocks, etc., may contact the filter and puncture and/or cut the filter. As a result of this damage to the filter, larger particles can thereafter pass through the filter and into the motor chamber of the vacuum cleaner thereby resulting in damage to the motor and/or fan, and/or the clogging of the air exhaust of the vacuum cleaner. Alternatively, the particle filter(s) may be inadvertently left out of the vacuum cleaner or improperly inserted in the vacuum cleaner thus allowing particles to enter the motor chamber. The safety filter is designed to inhibit or prevent such particles from entering the motor chamber. In one embodiment, the safety filter is designed to remove primarily larger particles and allow smaller particles to pass there through. Such a design allows the filter to be made of a less dense material so as to not significantly contribute to pressure drop through the filtering system. In another embodiment, the safety filter is a conically or a cylindrically shaped filter. In still another embodiment, the safety filter is designed to be inserted into an inner region of the support member of the support arrangement. In such a design, the outer peripheral surface of the support member supports one or more filters of the filtering system and an inner region of the support member receives the safety filter. Typically, the safety filter has generally the same shape as the shape of the outer peripheral surface of the support member and/or the one of more filters supported by the outer peripheral surface of the support member; however, the safety filter can have other shapes. In yet another embodiment, the safety filter is held in position in the support member by a filter support. The filter support can also maintain the shape of the safety filter during the vacuum process so as to minimize or prevent deformation of the safety filter. In one specific design, the filter support is nested in the safety filter while the safety filter nests in the support member. In another specific design, the filter support allows for easy removal and replacement or cleaning of the safety filter. In another design, the safety filter and filter support are at least partially entrapped between two or more pieces of the support member.

In accordance with a further aspect of the invention, the filtering system includes a post exhaust gas filter. The post exhaust gas filter is designed to remove undesired gases and/or odors such as, but not limited to, smoke, fumes, gas contaminants, and/or noxious gases from the filtered air after the filtered air exits the motor section of the vacuum cleaner. In past vacuum cleaner designs, all the filters were positioned upstream from the motor section, and the filtered air was blown directly out of the motor section and into the environment. As a result, odors caused from the operation of the vacuum motor were expelled from the vacuum cleaner. The positioning of the post exhaust gas filter at a location after the filtered air exits the motor section allows the gas filter to absorb odors caused by the motor and any odor that may have penetrated the other filters of the filtering system. Consequently, substantially odor free air is expelled from the vacuum cleaner during the vacuuming process. In one embodiment, the post exhaust gas filter is the only or primary gas filter in the filtering system. In another embodiment, the post exhaust gas filter is a secondary gas filter in the filtering system. In still another embodiment, the post exhaust gas filter can be removed from the vacuum cleaner without having to remove one or more other filters of the filtering system. As a result, the post exhaust gas filter can be replaced as needed independently of the other filters of the filtering system. In yet another embodiment, the gas filter includes a gas absorbing substance such as, but not limited to, activated carbon, activated charcoal, lava rocks, and/or baking soda. In still yet another embodiment, the gas filter includes one or more mats, or woven and/or non-woven materials impregnated with one or more gas absorbing substances. In a further embodiment, the gas filter includes one or more gas absorbing substances in the form of a resin and/or granules. In one aspect of this embodiment, the resin and/or granules are contained in an air permeable device such as, but not limited to, a ventilative bag, ventilative container and/or the like. In still a further embodiment, the gas filter includes one or more gas absorbing substances impregnated in a textile material.

In accordance with yet a further aspect of the invention, the filtering system includes a post exhaust air freshener. The post exhaust air freshener is designed to emit pleasant odors in the air exiting the vacuum cleaner. In one embodiment, the post exhaust air freshener can be removed and replaced from the vacuum cleaner without having to remove one or more filters of the filtering system. As a result, the post exhaust air freshener can be replaced as needed independently of the filters of the filtering system.

In accordance with still a further aspect of the present invention, the filtering system includes a filter liner to enable more convenient disposal of large particles that have fallen to the base or bottom of the low velocity chamber. In prior canister type vacuum cleaners, large particles accumulated at the bottom of the low velocity chamber during the vacuuming process. When the filters were replaced, the filters were removed and the bottom portion of the canister had to be carried out to a garbage can or other disposal area to be emptied. The carrying of the canister was both inconvenient and difficult. In addition, the emptying of the canister caused dust and other types of particles to be scattered about resulting in the individual being exposed to unwanted particles. After the canister was emptied, the user then had to wipe and clean the interior of the canister prior to reuse, thereby exposing the user to more particles and dust. The filter liner is designed to collect the particles that have fallen to the base or bottom of the low velocity chamber. As a result, the liner need only be removed with the filters to remove all the particles in the canister. The liner can be closed to minimize dust escaping during the filter replacement and disposal process. The liner also maintains the cleanliness of the inside of the canister thereby eliminating the need to clean the canister by hand after every disposal of the liner and filter. In one embodiment, the liner is made of a flexible material so as to be easily placed in the low velocity chamber. In one aspect of this embodiment, the liner is made of a cellulose material or paper that is coated on at least one side with a plastic film or other dust impenetrable film. In another aspect of this embodiment, the liner is made of a flexible plastic material. In another embodiment, the liner is connected to or secured to one or more filters of the filter system. In one aspect of this embodiment, the liner is connected to one or more filters by a melted seam, adhesive, and/or stitching.

In accordance with yet a further aspect of the present invention, the vacuum cleaner includes a removable canister to facilitate in the convenient disposal of dust and debris collected in the low velocity chamber. In prior canister type vacuum cleaners, the whole base portion of the vacuum cleaner had to be transported to a garbage can, lifted, and then turned over to dispose of the dust and debris that had collected in the low velocity chamber. Due to the bulkiness of the canister, the process of disposal of the dust and debris was not convenient and, at often times, difficult. The vacuum cleaner of the present invention overcomes this problem by designing a canister type vacuum cleaner that includes a lower canister that can be easily separated from the rest of the vacuum cleaner to enable a user to easily and conveniently dispose of dust and debris that has collected in the low velocity chamber. In one embodiment, the removable lower canister includes a handle. The handle allows a user to easily grasp the lower canister for convenient removal and reinsertion of the canister. The handle also makes is easier for the user to carry the low canister to a garbage can or other disposal area. In another embodiment, the lower canister is designed to be slidably removable from the vacuum cleaner when the top portion of the vacuum cleaner is lifted and/or removed.

In accordance with another aspect of the invention, the low velocity chamber of the vacuum cleaner includes an inlet nozzle that directs particle containing air about the filters in the low velocity chamber. The inlet nozzle, in effect, facilitates in the cyclonic air paths in the low velocity chamber. The inlet nozzle also directs the entering air about the filters in the low velocity chamber as opposed to directly at the filters. In prior canister vacuum cleaners, the low velocity chamber included an opening on one side of the chamber wall to allow entry of incoming air. The incoming air was directed at the filters and then began its cyclonic pathway. As a result, the area on the filter that was in the path of the incoming air prematurely became clogged with particles thereby reducing the efficiency and life of the filter. The inlet nozzle of the present vacuum cleaner overcomes this problem by causing the incoming air to immediately begin a cyclonic pathway about the filters thereby resulting in a more uniform distribution of particles about the filter during the filtering process. In one embodiment, the inlet nozzle is positioned at or close to the base of the low velocity chamber and extends into the interior of the low velocity chamber. The positioning of the inlet nozzle functions as a barrier to large particles that have fallen to the base of the low velocity chamber from continuing to circulate in the low velocity chamber. As a result, less particles are restirred in the low velocity chamber thereby increasing the efficiency and effectiveness of the filters in the low velocity chamber.

In accordance with still another aspect of the invention, the vacuum cleaner includes an air exhaust that increases the efficiency of air flow through the vacuum cleaner. Prior canister vacuum cleaners directed filtered air through several openings positioned about the perimeter of the motor housing. It has been found that by directing all of the filtered air through a single opening, the throughput efficiency of the air is increased. In one embodiment, a motor housing is included about the motor and fan of the vacuum cleaner and includes a single opening for allowing the filtered air to exit the housing. In another embodiment, an expanding air passageway is connected to the opening of the motor housing. The expanding passageway at least partially directs filtered air from the motor housing to the external housing of the vacuum cleaner. In one aspect of this embodiment, the width of the expanding passageway at least partially expands along the length of the expanding passageway. In another aspect of this embodiment, the height of the expanding passageway at least partially expands along the length of the expanding passageway. In still another embodiment, the expanding air passageway directs filtered air into an exhaust chamber that includes one or more filters and/or air fresheners. In one aspect of this embodiment, the opening into the exhaust chamber is greater than the opening of the motor housing. In another aspect of this embodiment, the filter in the exhaust chamber includes a gas filter. In still another aspect of this embodiment, the filter in the exhaust chamber includes a particle filter. In still yet another aspect of this embodiment, the exhaust chamber includes an air freshener. In yet another aspect of this embodiment, the exhaust chamber includes a single opening to expel filtered air from the external housing of the vacuum cleaner. In one specific design, the opening in the exhaust chamber is similar in size to the opening into the low velocity chamber. In another specific design, the opening in the exhaust chamber is similar in size to the opening between the motor housing and expanding air passageway.

The primary object of the present invention is the provision of a novel filter system that can effectively filter out a majority of the particles entrained in the air and/or to remove odors in the air as the air passes through the filter without causing a large pressure drop and can be easily used in a vacuum cleaner such as a canister type vacuum cleaner.

Another and/or alternative object of the present invention is the provision of a filter system which can be easily changed.

Still yet another and/or alternative object of the present invention is the provision of a filter system which has a large area.

Yet another and/or alternative object of the present invention is the provision of a conical filter system adapted to be held in a nested position.

Still a further and/or alternative object of the present invention is the provision of a filter system which is fixedly located in the reduced air velocity chamber of a vacuum cleaner so that low velocity air passes through the filter system to provide resident time to contact the large surface area of the filter system so as to remove particles from the air being cleaned by the vacuum cleaner.

A further and/or alternative object of the present invention is a vacuum cleaner which includes using a particle filter in combination with a gas filter to remove both particles and unwanted gases from the air.

Another and/or alternative object of the present invention is a vacuum cleaner designed to minimize the air pressure drop throughout the vacuum cleaner thereby reducing the need for a large motor to draw in and expel air from the vacuum cleaner.

Still another and/or alternative object of the present invention is the design of a compact and portable vacuum cleaner which can be easily moved to different rooms by a user.

Yet another and/or alternative object of the present invention is a vacuum cleaner that includes a liner to conveniently remove settled particles and debris in the vacuum cleaner.

Still yet another and/or alternative object of the present invention is a vacuum cleaner that has a removable canister to facilitate in easier cleaning of the vacuum cleaner.

A further and/or alternative object of the present invention is a vacuum cleaner that filters gases from the exhaust of the vacuum cleaner.

Still a further and/or alternative object of the present invention is a vacuum cleaner that includes a particle filter having a rib and trough profile that efficiently removes small particles entrained in the air.

Another and/or alternative object of the present invention is a vacuum cleaner that freshens air prior to exhausting the air from the vacuum cleaner.

Yet another and/or alternative object of the present invention is a vacuum cleaner that has a filter support that causes ribs and trough sections to be formed in a filter when the filter at least partially collapses on the filter support during operation of the vacuum cleaner.

Still another and/or alternative object of the present invention is a vacuum cleaner that has a filter to prevent large particles from entering the motor chamber of the vacuum cleaner.

These and other objects and advantages will become apparent from the following description taken together with the accompanying drawings.

BRIEF DESCRIPTION OF THE DRAWINGS

Reference is now made to the drawings, which illustrate various embodiments that the invention may take in physical form and in certain parts and arrangement of parts wherein.

DESCRIPTION OF THE PREFERRED EMBODIMENT

Figure 1:
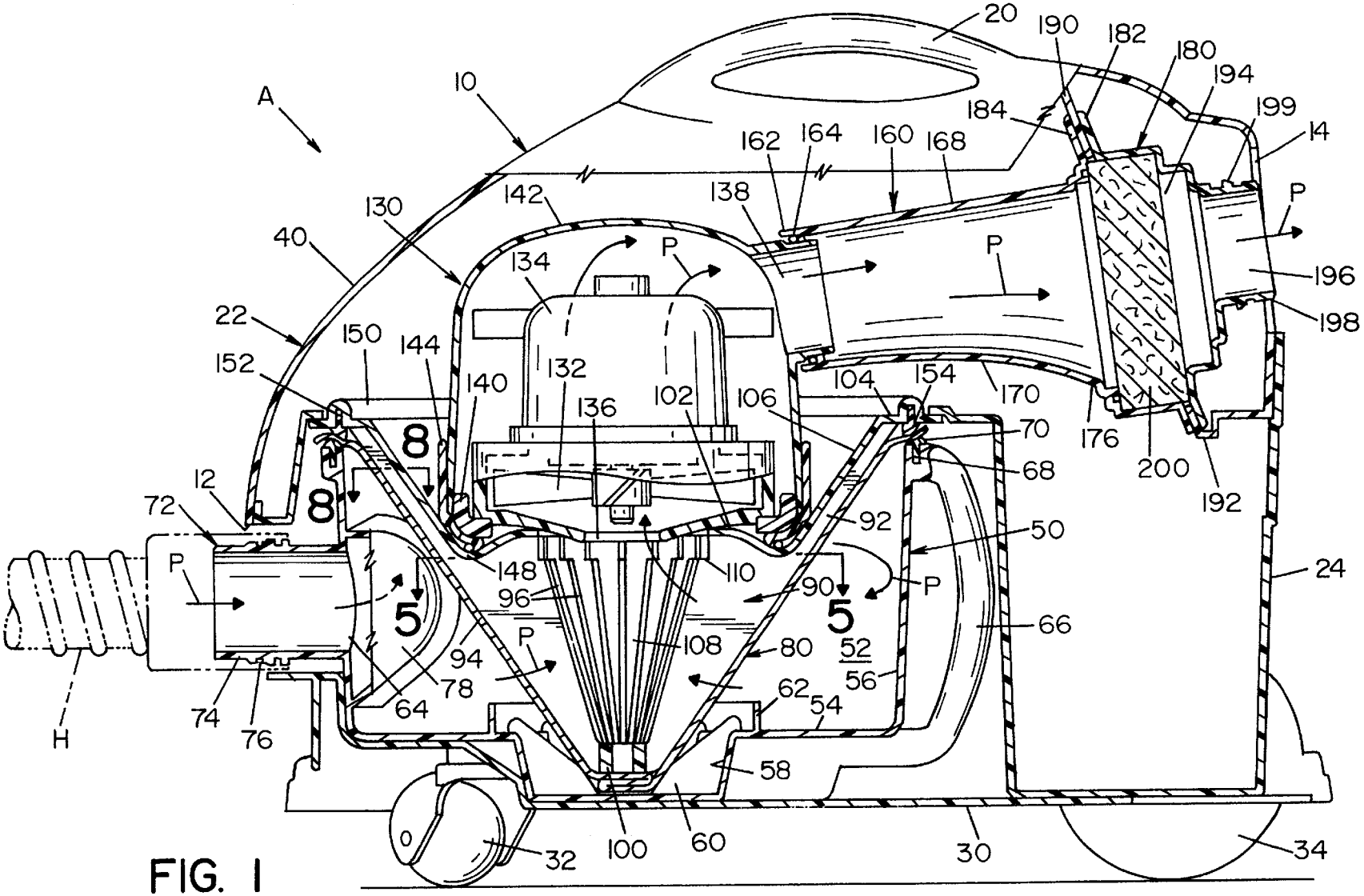
FIG. 1 is a cross-section view of the canister type vacuum cleaner of the present invention.

Referring now to the drawings wherein the showings are for the purpose of illustrating a preferred embodiment of the invention only and not for the purpose of limiting same, FIG. 1 shows a canister type vacuum cleaner A having a housing 10 which is similar in design to the vacuum cleaner housing disclosed in U.S. Pat. No. Des. 432,746. At the top of the housing, there is a handle 20 designed to enable a user to carry or move the vacuum cleaner to various locations, and/or to lift a portion of the housing to access one or more internal components of the vacuum cleaner such as the filters. Secured to the base 30 of the housing are two sets of wheels 32, 34. Wheels 32 are swivel wheels that are connected to the front of the base and enable the vacuum cleaner to be moved in a variety of directions. Wheels 34 are non-swivel wheels that are connected to the rear of the base. As can be appreciated, all the wheels can be the same type of wheel. A portion of the housing includes a clear or transparent section or panel 40 which enables a user to view into the interior of the housing. Typically, the clear section 40 allows the user to view the amount of dust and/or dirt that has accumulated in the low velocity chamber 52. The clear section 40 may also or alternatively allow the user to view the condition of one or more filters in the low velocity chamber so that the user can determine if one or more filters need to be replaced.

Housed in housing 10 includes a canister 50, a motor housing 130, expanding exhaust conduit 160, and an exhaust filter housing 180. Canister 50 includes a generally cylindrical low velocity chamber 52. Low velocity chamber 52 includes a base 54 and side wall 56. The base 54 includes filter well 58 containing a filter support 60 and a dirt flange 62 positioned about the filter well. Side wall 56 includes a side opening 64. Canister 50 also includes a handle 66 connected to the side wall 56. Positioned at the top of side wall 56 is a slot 68 which retains a seal ring 70. Positioned in side opening 64 is an inlet nozzle 72. Inlet nozzle 72 includes a tubular extension 74 that extends outwardly from canister 50 and through an opening 12 in housing 10. Positioned on the outer surface of tubular extension 74 are a plurality of ribs or ridges 76 which are designed to secure a vacuum hose H to tubular extension 74. Inlet nozzle 72 also includes an elbow section 78 positioned in the interior of the low velocity chamber.

Figure 11:
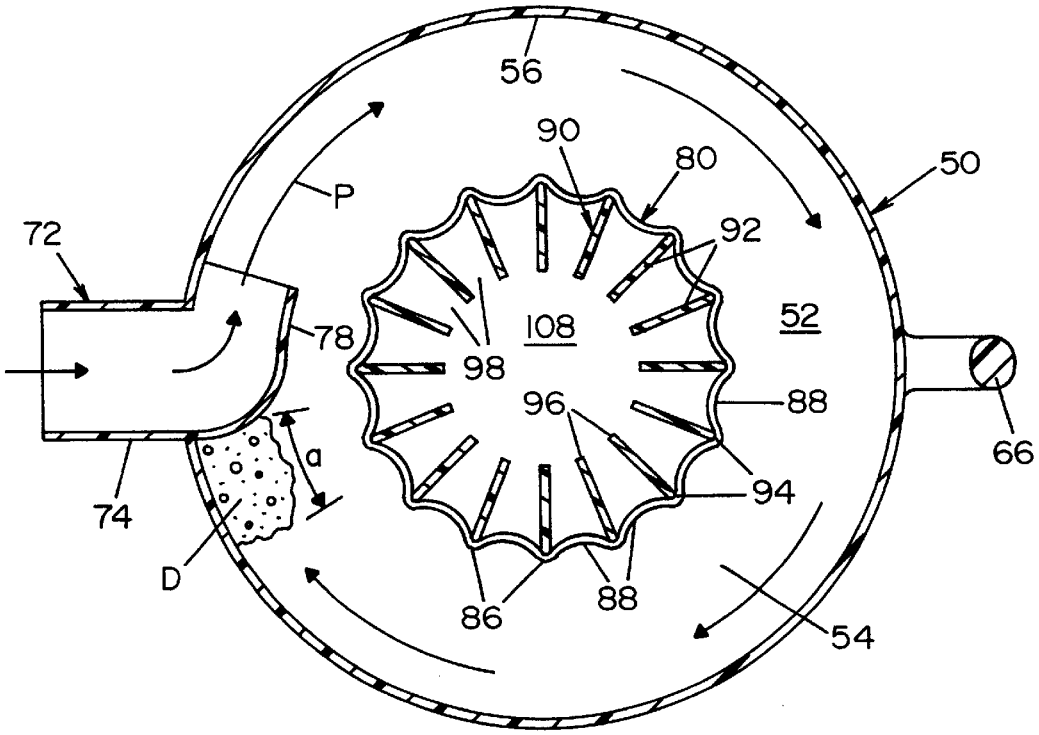
FIGS. 11 and 12 are top views of the low velocity chamber of the vacuum cleaner illustrating the accumulation of large particles adjacent the inlet nozzle.
Figure 12:
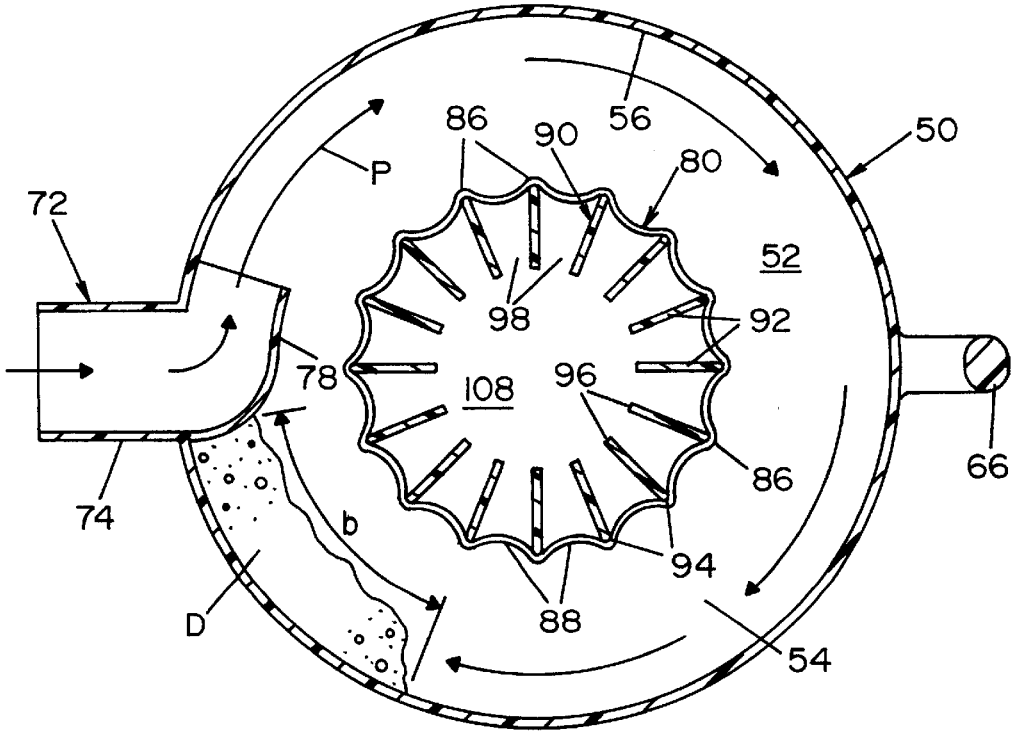
Figure 13:
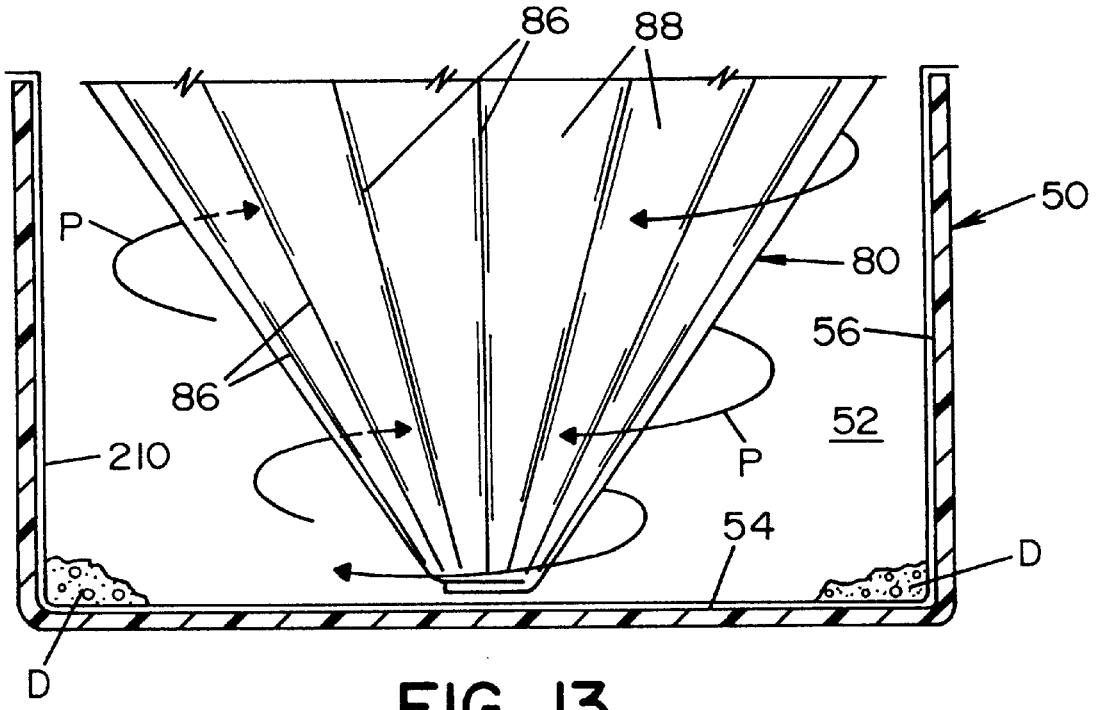
FIG. 13 is a cross-section view of the low velocity chamber illustrating the cyclonic air flow about the filter and the use of a liner in the low velocity chamber.

Air flow through the vacuum cleaner is illustrated by arrows defining a path P. As shown in FIG. 1, particle entrained air flows through hose H and into tubular extension 74 of inlet nozzle 72. The particle entrained air continues to flow through inlet nozzle 72, and the air path is altered by elbow section 78. In low velocity chamber 52, path P is in the form of a vortexed or cyclone of several convolutions so that particles carried by air into the low velocity chamber are removed by centrifugal force. Referring to FIGS. 11–13, the air flow in the low velocity chamber is illustrated. The air passing through inlet nozzle 72 has a much higher velocity than in the low velocity chamber. As a result, large particles in the air are carried through hose H and through the inlet nozzle by the high velocity air. When the air enters the low velocity chamber, the air velocity significantly reduces, thus resulting in the larger particles D precipitating out of the air stream and falling to the base of the low velocity chamber. The path of the air flow as shown in FIGS. 11 and 12 begins along side wall 56 of the low velocity chamber. As a result, the larger particles fall to the base at or near the side wall of the low velocity chamber. The path of the air flow then causes the particles at the base of the low velocity chamber to move slowly about the perimeter of the base. As shown in FIG. 11, the elbow section of inlet nozzle 72 functions as a barrier to inhibit or prevent the particles from continuing to circulate about the base of the low velocity chamber. The accumulated large particles D are represented by volume a. The reduction in movement or swirling of the larger particles increases filter efficiency and reduces the number of larger particles becoming re-entrained in the air. As the volume of large particles D increases in the low velocity chamber, the amount of accumulation behind the elbow section represented by volume b increases, as shown in FIG. 12. Dirt flange 62, as shown in FIG. 1, and side wall 56 maintain the accumulated particles in a specific region on the base of the low velocity chamber.

The air flow path P in the low velocity chamber maintains a generally cyclonic pathway until the air contacts filter 80. Thereafter, air flow path P is generally in an upwardly vertical direction so that the air being cleaned moves through a generally conically shaped filter 80. The generally conical filter is designed to remove very small particles from the air. Typically, filter 80 is a high efficiency particulate air (HEPA) filter. The filter can include one or more filter sections to remove particles mechanically and/or electrostatically from the air. When filter 80 is made of multiple layers, the multiple layers can be connected together by any conventional means. The fibers used in the filter may be all cellulosic fibers, all synthetic textile fibers or a mixture of cellulosic fibers and synthetic textile fibers. A wide variety of synthetic fibers may be used including acrylic fibers, polyester fibers, nylon fibers, olefin fibers, and/or vinyl fibers, and the like. The cellulosic fiber may be cellulose fibers, modified cellulose fibers, methylcellulose fibers, rayon, and/or cotton fibers. Generally, the filter layers are connected together by a binder, melted seam, adhesive, stitching, and/or needle pointed together. The materials used to form each layer may be the same or different. In addition, the layers may be all woven or non-woven or a combination thereof. Typically, the exterior surface 82 of filter 80 is made up of a relatively durable material so as to resist damage to the filter during operation of the vacuum cleaner and/or during insertion on or removal of the filter from the vacuum cleaner. Filter 80 is typically formed of materials which resist growth to mold, mildew, fungus, or bacteria. The materials also typically resist degradation over time and are able to withstand extremes in temperatures and humidity, i.e. up to 70° C. (158° F.) and 100% relative humidity. As can be appreciated, filter 80 can be designed to be, if desired, used in both wet and dry environments.

Typically, filter 80 removes substantially all particles having a size greater than two microns. Filter 80 typically has about a 99% air filtration efficiency for particles greater than two microns in size. In one specific design, filter 80 filters out over about 99.9% of the particles 2 micron or greater in size, and typically over about 99% of the particles about 0.3 micron or greater in size. For particles from about 0.3–2.0 microns, filter 80 generally has a filtration efficiency of at least about 70% and more preferably at least about 99.9%. Particle removal efficiencies as high as 99.98% for particles 0.1 micron and greater in size and at air flow rates of 10–60 CFM are achievable by filter 80. As a result, out of the millions of air particles entering the low velocity chamber of the vacuum cleaner, only a relatively few extremely small particles pass through filter 80. The weight of the materials of filter 80 generally are about 30–300 gm/m$^2$, and typically about 50–250 gm/m$^2$, which results in a very nominal pressure drop as the air passes through filter 80.

Filter 80 can also include a gas absorbing substance 84. The gas absorbing substance can be incorporated into the particle filter layer or layers and/or be formed from a separate filter layer and/or altogether separate filter. The gas absorbing substance is designed to remove undesirable gases from the air such as smoke or other undesirable odors. The gas absorbing substance can include a variety of powders such as, but not limited to, activated carbon, activated charcoal, diatomaceous earth, Fuller's earth, volcanic rock, lava rock, baking soda, and/or the like. The gas absorbing substance typically removes odors caused by, but not limited to, aromatic solvents, polynuclear aromatics, halogenated aromatics, phenolics, aliphatic amines, aromatic amines, ketones, esters, ethers, alcohols, fuels, halogenated solvents, aliphatic acids, and/or aromatic acids. One particular gas and particle filter which can be used is sold under the trademark MEDIpure. The MEDIpure filter is more fully described in U.S. Pat. No. 6,090,184, which is incorporated by reference.

Figure 20:
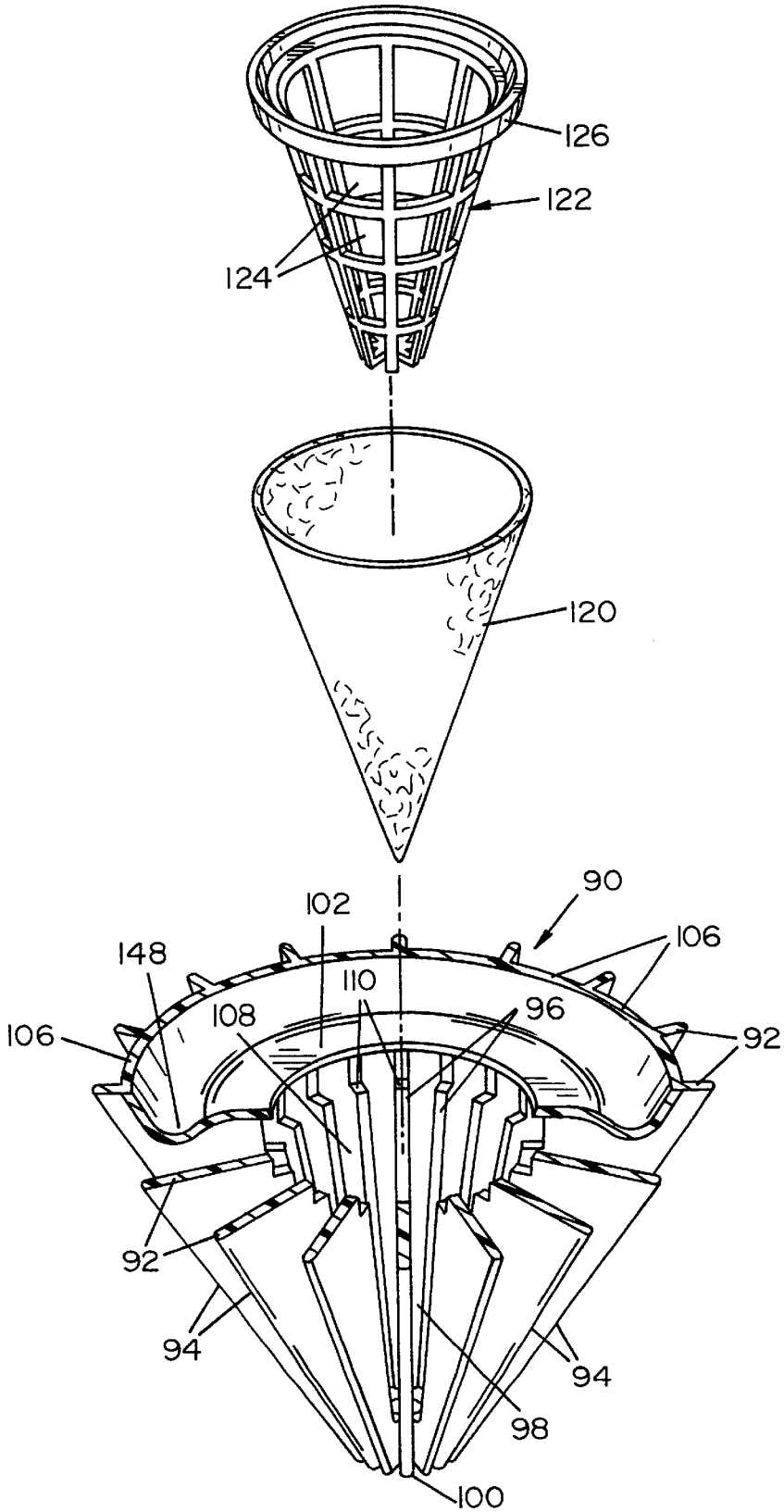
FIG. 20 is an exploded perspective view of FIG. 19 illustrating the filter support, the safety filter and safety filter support.

The shape and position of the conical filter 80 is maintained by a filter support 90. Typically, the filter support nests within filter 80. Referring now to FIGS. 1, 3–5 and 20, filter support 90 is conically shaped and formed by a plurality of fin sections 92 that are generally positioned symmetrically from one another. Each fin section has an outer edge 94 and inner edge 96. The lower portion of the filter support includes an opening 98 positioned between two adjacently positioned fin sections. The fin sections are maintained in position with respect to one another by being connected together at the base 100 of the filter support. Positioned approximately mid-height of the filter support is a rigidity ring 102 that connects the fin sections together. The filter support also includes a top rim 104. Positioned between the top rim and rigidity ring are rigidity panels 106 positioned between two adjacent fin sections. The rigidity panels can include openings but are typically solid. As best shown in FIGS. 1 and 20, the inner edge of the fin sections form an inner cavity 108. The inner cavity is conically shaped; however, other shapes can be formed. The inner cavity includes a top ledge 110 positioned below the rigidity ring.

Figure 19:
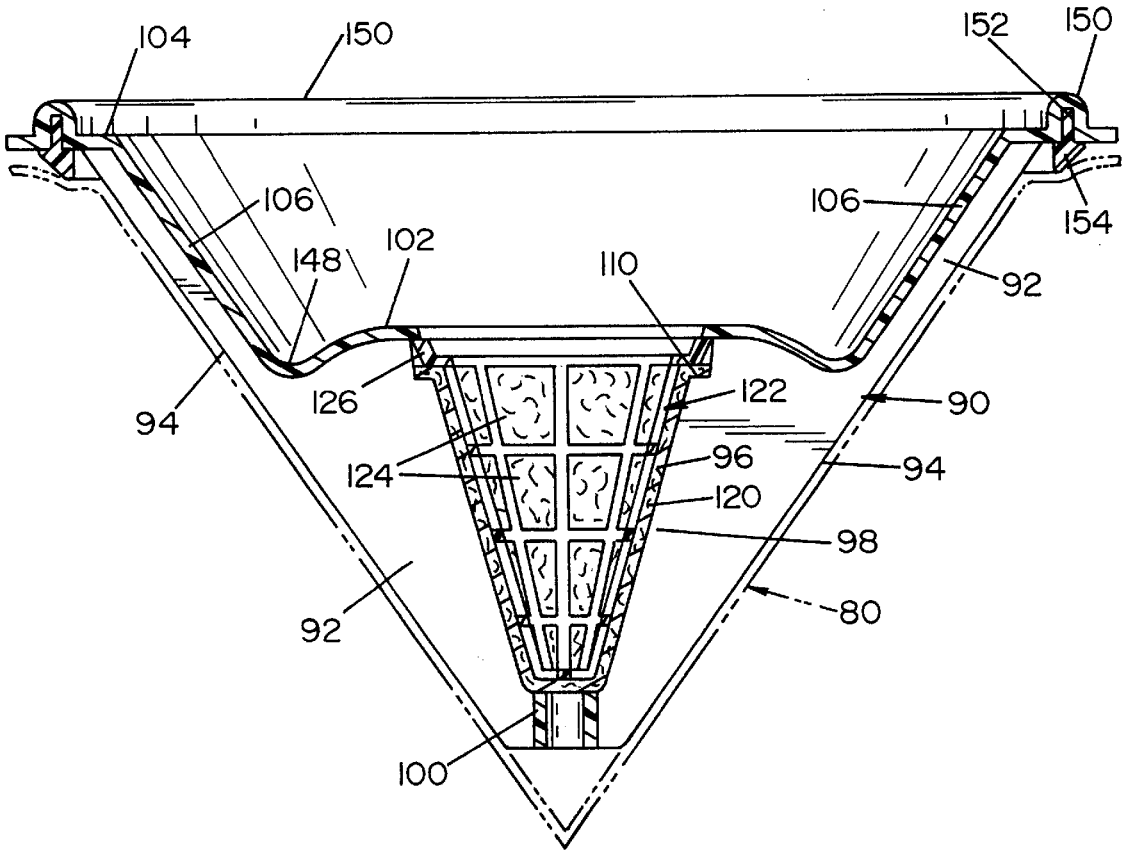
FIG. 19 is a cross-sectional view of the safety filter nested in the interior of the filter support of the present invention.

Referring now to FIGS. 19 and 20, a safety filter 120 is positioned in inner cavity 108. The safety filter 120 is designed to inhibit or prevent large particles or other articles from entering the motor housing and causing damage to the components in the motor housing. Large particles can enter the motor housing when filter 80 becomes torn or otherwise damaged, is improperly positioned in the vacuum cleaner, and/or if the user forgets to place filter 80 in the vacuum cleaner prior to use. Safety filter 120 is used to capture or entrap large particles that pass through the openings of the filter support. As shown in FIG. 20, the safety filter is conical in shape to fit in inner cavity 108. A conically shaped safety filter support 122 is used to maintain the safety filter in the inner cavity. The safety filter support includes a plurality of openings 124 and a rim 126. Rim 126 is designed to be positioned on top of ledge 110 when inserted into filter support 90, as shown in FIG. 19.

As so far described, air enters the low velocity chamber and large particles fall to the base of the low velocity chamber. The small particles in the air are then directed to filter 80 wherein a majority of the particles are filtered out of the air by the filter. The filtered air passing through the filter passes through openings 98 in the filter support. The filtered air then passes through safety filter 120 that is positioned in inner cavity 108 of the filter support. The filtered air then passes through the safety filter and into the motor housing in a direction defined by air path P, as shown in FIG. 1.

Figure 14:
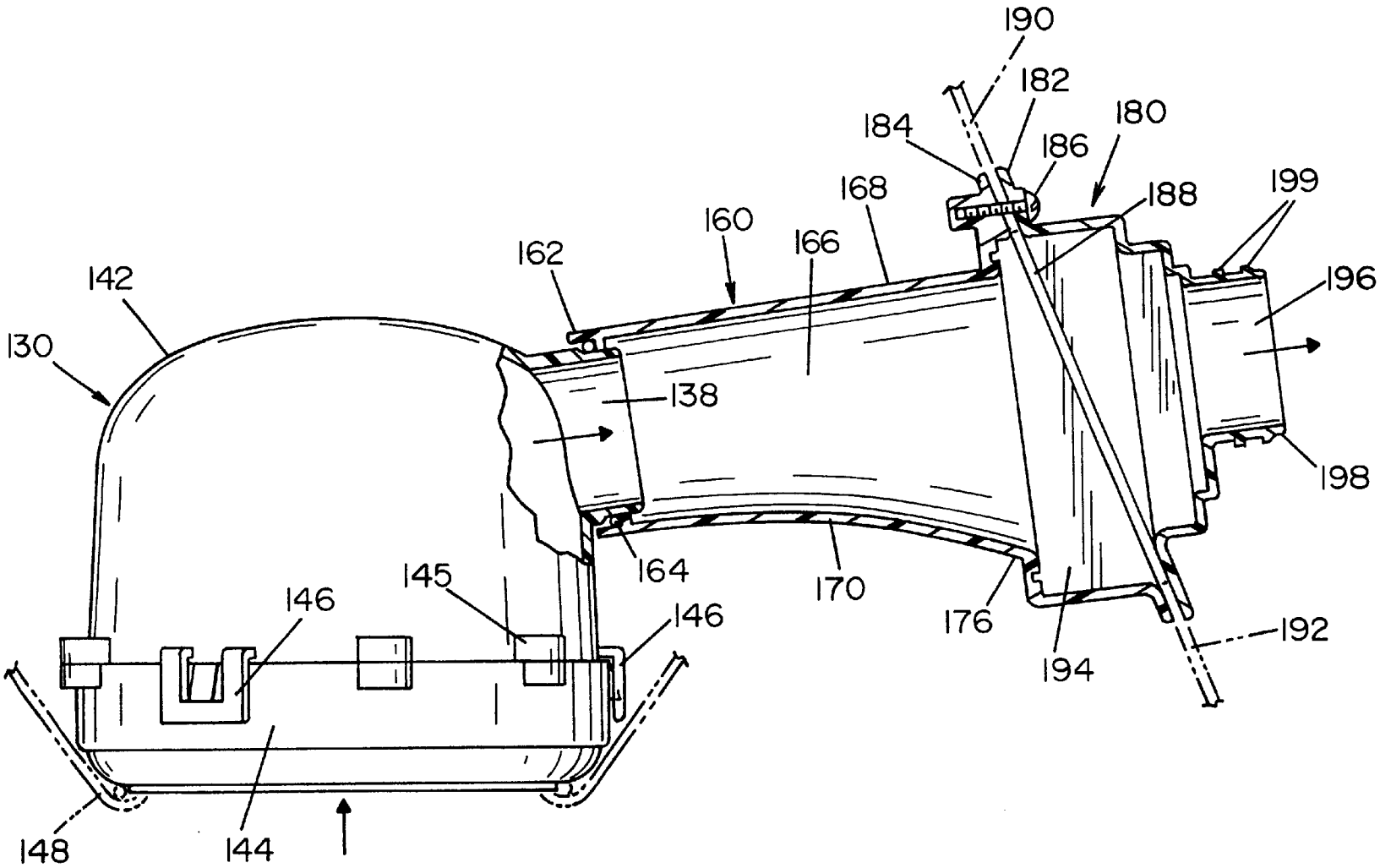
FIG. 14 is an enlarged side elevation view of the top portion of the vacuum cleaner of FIG. 1 illustrating a partial cut away view of the expanding exhaust conduit and exhaust filter.

Air is drawn through filter 80 by a fan 132 driven by a motor 134, both of which are positioned in the motor housing 130. The motor housing includes a lower inlet 136 and an air exhaust opening 138. The motor is typically an electric motor powered by 120 or 240 V and causes fan 132 to rotate at about 10000–30000 RPM. The turning fan causes the air to flow through the low velocity chamber at about 20–100 CFM. The static suction produced by the rotating fan is about 40–150 inches plus the water lift. The motor rests on a vibration ring 140 to minimize noise and vibration during operation of the vacuum cleaner. As illustrated in FIG. 14, the motor housing includes an upper section 142 and a lower section 144. Several orientation slots 145 and lock tab arrangements 146 are used to connect the upper and lower sections together. A housing support 148 supports the motor housing on the top of the low velocity chamber. The end of the housing support forms a rim 150 that includes a seal slot 152 and a seal ring 154 positioned therein. As shown in FIG. 1, the end of filter 80 is secured between seal ring 154 on housing support 148 and seal ring 70 on the top of side wall 56. The seal formed between seal rings 70 and 154 inhibits or prevents air from bypassing filter 80 and entering the motor housing when the motor housing is positioned on the top of canister 50.

Figure 16:
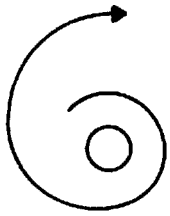
FIG. 16 (PRIOR ART)
FIG. 16 is a graphical illustration of the air flow from the top of the motor housing of prior art canister type vacuum cleaners.
Figure 17:
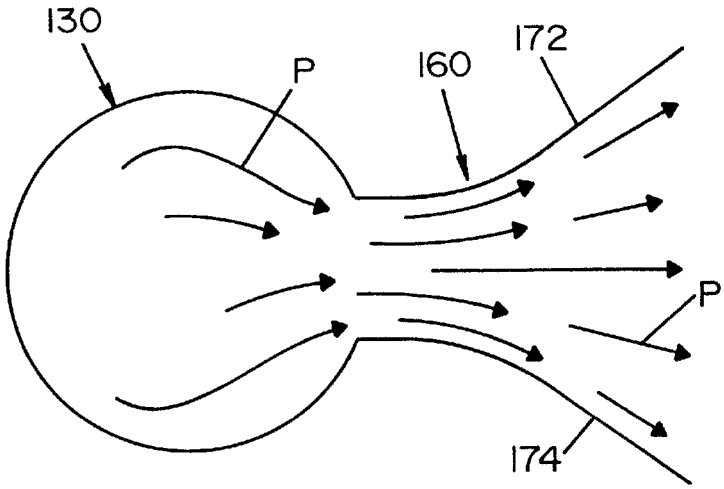
FIG. 17 is a graphical illustration of the air flow from the top of the motor housing and expanding exhaust conduit of the present invention.
Figure 18:
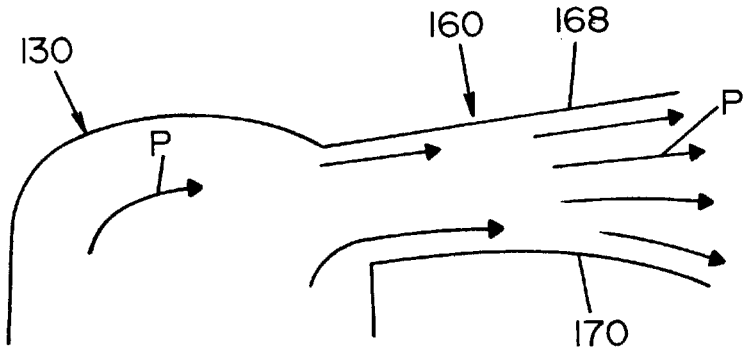
FIG. 18 is a graphical illustration of the air flow from the side of the motor housing and expanding exhaust conduit of the present invention.

As shown in FIG. 1, all the air entering lower inlet 136 is directed though air exhaust 138. The path of air flow in the motor housing through the expanding exhaust conduit 160 is illustrated in FIGS. 17 and 18. In prior canister type vacuum cleaners, the air exhaust of the motor housing included a plurality of openings about the perimeter of the motor housing. This air flow pattern out of the motor housing is illustrated in FIG. 16. Motor housing 130 alters this prior art exhaust air flow path by forcing the exhaust air through a single opening as illustrated in FIG. 17. Surprisingly, it has been found that the flow rate of air through the vacuum cleaner is increased by this new exhaust air flow.

Figure 15:
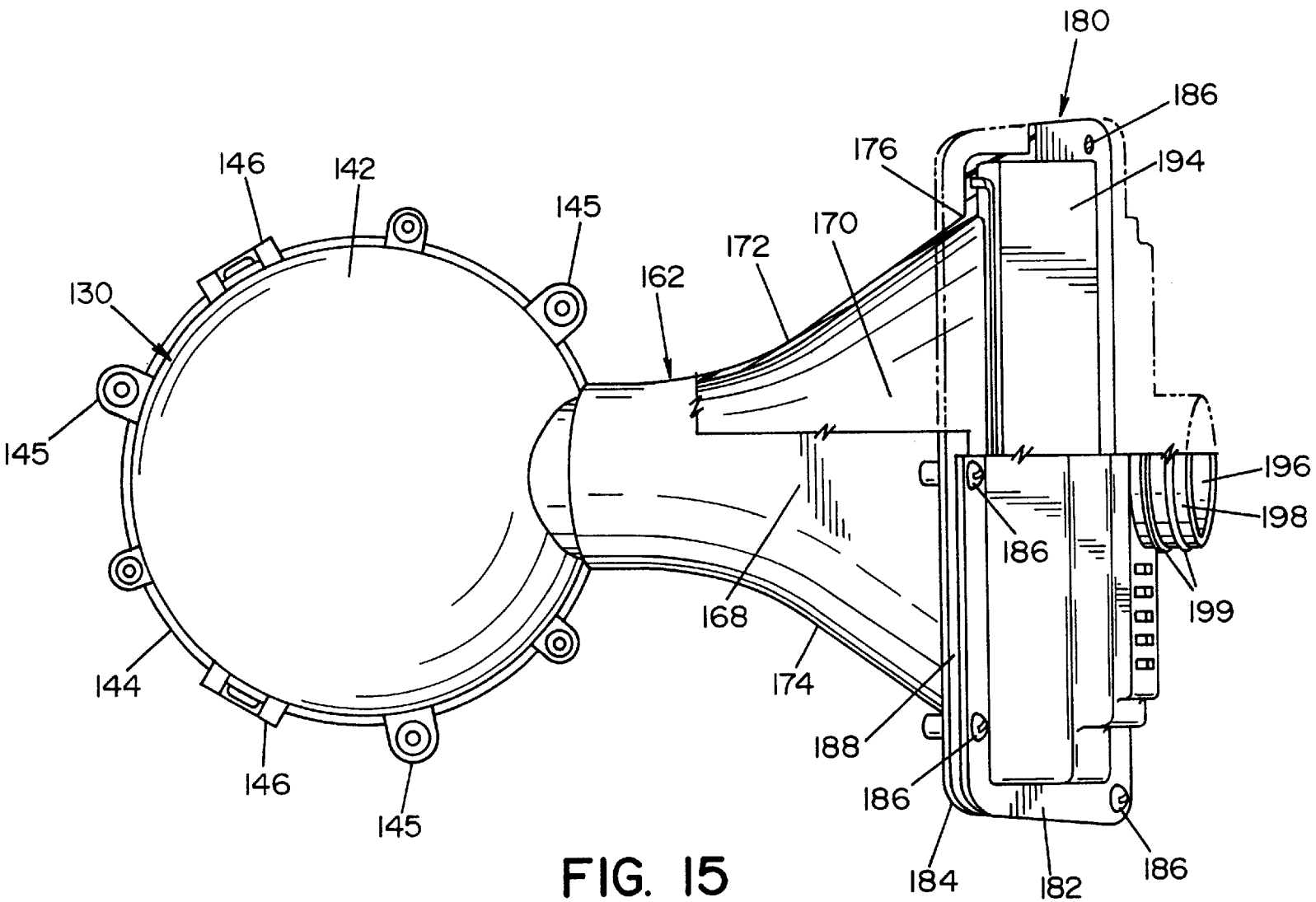
FIG. 15 is a top view of the top portion of the vacuum cleaner of FIG. 14 illustrating a partial cut away view of the expanding exhaust conduit and exhaust filter.

Referring again to FIG. 1, after the exhaust air exits opening 138 of the motor housing, the exhausted air enters an expanding conduit 160. The first end 162 of the conduit telescopically receives a portion of a rim about opening 138, and a seal ring 164 is positioned about the rim so as to direct most, if not all, of the exhausted air into the conduit. Referring now to FIGS. 1, 14 and 15, the conduit expands in size along the longitudinal length of the conduit. As shown in FIG. 14, the height of the inner passageway 166 of the conduit increases along the longitudinal length of the conduit. The increase in height is caused by upper wall 168 remaining substantially planar and bottom wall 170 having an arcuate shape that curves downwardly. As can be appreciated, many other arrangements can be used to cause the height of the passageway to increase such as, but not limited to, the upper wall curving upwardly and the bottom wall remaining substantially planar, both the upper and lower wall curving away from one another, one or both walls being planar and angling away from one another, etc. The width of inner passageway 166 also increases along the longitudinal length of the conduit, as shown in FIG. 15. The side walls 172, 174 both curving away from one another cause the width of the conduit to increase. As can be appreciated, the width, like the height, of the conduit can be increased by use of other conduit configurations such as, but not limited to, side wall 172 curving outwardly and side wall 174 remaining substantially planar, side wall 174 curving outwardly and side wall 172 remaining substantially planar, one or both walls being planar and angling away from one another, etc. It has been found that by causing the size of the passageway to increase along the longitudinal length of the conduit, the through put of air is increased. This is believed to be caused by venturi expansion effects. The combined use of the motor housing and expanding conduit have resulted in at least 5% and typically 10–40% greater efficiencies in air through put.

The filtered air, upon exiting the conduit through the conduit second end 176, enters exhaust filter housing 180. The filter housing 180 includes a front and rear wall section 182, 184. The two sections are connected together by a plurality of screws 186; however, the two wall sections can be connected together by other means. As shown in FIG. 14, the rear wall includes a slot 188 used to connect the rear wall to the second end 176 of conduit 160. Support flanges 190, 192 are secured between the front and rear wall sections. The support flanges stabilize and secure the filter housing in vacuum cleaner housing 10. Positioned in the filter chamber 194 and formed between the front and rear walls is a gas filter 200. The gas filter is designed to remove any noxious or undesired gases in the filtered exhausted air. The gas filter can take on a number of different forms so long as the exhausted air at least partially contacts one or more gas absorbing agents. Non-limiting forms of the gas filter include a granular and/or powered gas absorbing agent that is lacily piled up or formed in a rigid or semi-rigid shape, a granular and/or powered gas absorbing agent impregnated in a paper, mat and/or fabric material, etc. As can be appreciated, the gas filter can also be designed to filter out particles that still remain in the exhausted air. Although a gas filter is typically positioned in the filter housing, the gas filter can be substituted for a particle filter, if desired. In still another alternative, a scent agent can be positioned in the filter housing as an alterative to or in addition to one or more filters in the filter housing. The scent agent can be in the form of scented paper, a scented pad, scented bar, scented granules, etc. The scents agent is used to mask odors exiting the vacuum cleaner and/or to provide a fresh or desired scent to the environment while the user is cleaning.

After the exhausted air has passed through the filter in the filter housing, the exhausted air is directed through a restricted opening 196 in front wall 182. A opening flange 198 is portioned about the opening and includes one or more ridges 199 that are designed to secure hose H to the opening when the user desires to use the vacuum cleaner as a blower. As shown in FIG. 1, opening 196 extends through an exit opening 14 in housing 10.

Figure 9:
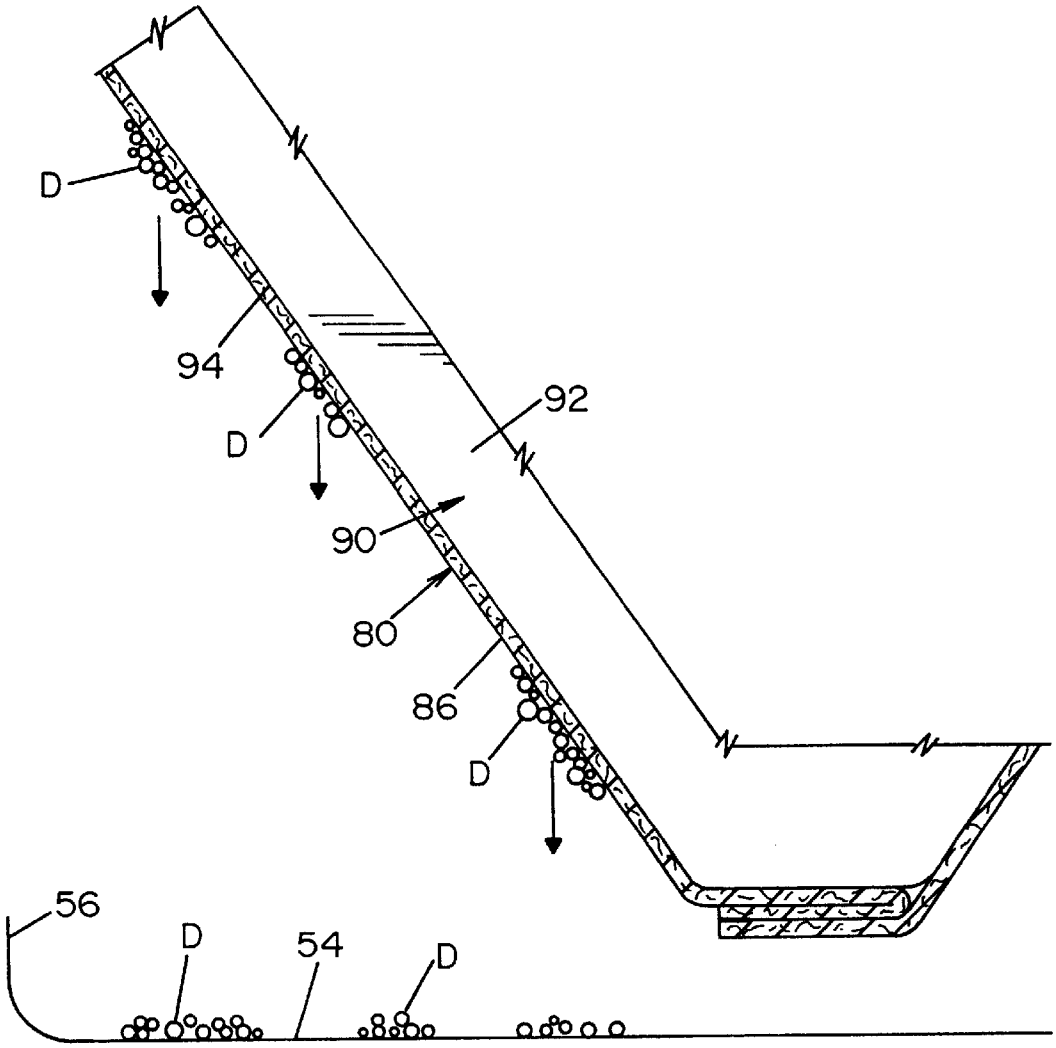
FIG. 9 is an enlarged sectional view of the base of the filter in FIG. 3 positioned in a low velocity chamber of the vacuum cleaner.

The procedures for changing the filters in the housing will now be described. As shown in FIG. 1, housing 10 includes an upper section 22 and a base 30. Upper section 22 is designed to pivot about opening 12 so that the user can access and remove canister 50 from the interior of housing 10. As shown in FIG. 1, back support 24 on upper section 22 rests on base 30 when the housing sections are closed. When the user needs to open the housing, back support 24 is lifted off base 30 and continues to pivot the upper section about a pivot point near opening 12, not shown, until canister 50 is exposed. The lifting of upper section 22 causes the motor housing to be lifted off filter support 90 and off of filter 80. As can be appreciated, the upper section can be designed such that the upper section is completely lifted off the base of the housing instead of being pivoted to an opened position. Once the upper section 22 has been pivoted into the open position, the user grasps handle 66 on the canister and slides the canister off base 30. The canister is then moved to a location to remove dirt D from the base of the low velocity chamber in the canister and to replace filter 80. During the replacement of the filters, the filter support 90 and filter 80 are lifted from filter support 60, and filter 80 is then removed from filter support 90 and disposed of. A new filter 80 is inserted about filter support 90, and the bottom of the filter is folded upon itself as shown in FIGS. 1, 9 and 13. The dirt D that has accumulated in the base of the low velocity chamber can be dumped into a garbage can or other disposal location. The canister is then wiped out to complete the cleaning of the canister.

As shown in FIG. 13, a dirt liner 210 can be inserted in the base of the low velocity chamber. If a liner is used, the liner is removed from the canister after the filter and filter support 90 have been removed. The use of the liner simplifies the disposal of dirt in the canister and reduces the amount of time and effort needed to clean the interior of the low velocity chamber after each filter replacement. If a liner is used, a new liner is inserted in the low velocity chamber prior to inserting the filter and filter support 90. Once the filter and filter support are repositioned in filter support 60 in the base of the low velocity chamber, the canister is repositioned on base 30 of housing 10. As can be appreciated, the liner, filter and/or filter support can be positioned in the low velocity chamber after the canister has been repositioned in the base. As can further be appreciated, the liner, filter and/or filter support can be removed from the low velocity chamber without having to first remove the canister from base 30. After the filter and filter support are positioned in the low velocity chamber, the upper edge of filter 80 is positioned over seal ring 70 on canister 50. Thereafter, the upper section 22 of housing 10 is pivoted back to the closed position. As shown in FIG. 1, back support 24 retains canister 50 in the proper position when the housing is closed. In addition, a seal is formed between the canister and upper housing by seal rings 70 and 154 on the canister and the motor housing, respectively. This procedure is repeated for further filter removals.

Figure 2:
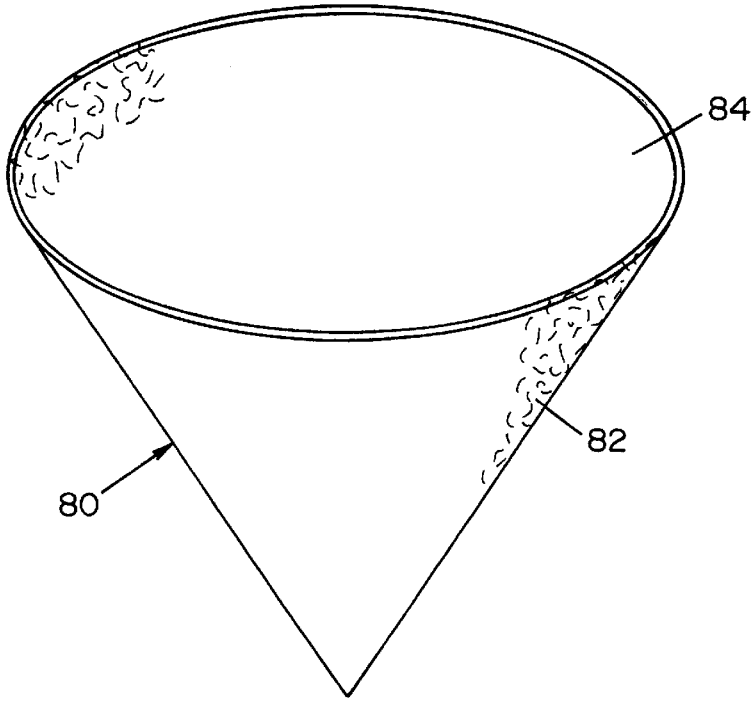
FIG. 2 is a perspective view of a standard conical tilter used in standard canister type vacuum cleaners.
Figure 3:
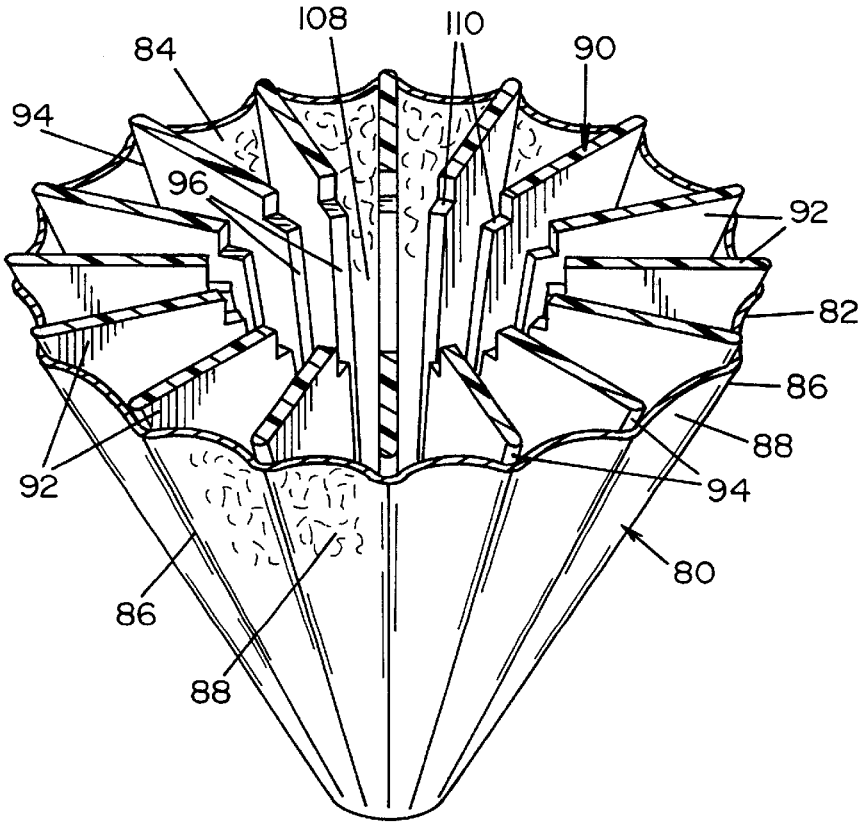
FIG. 3 is a perspective view of a standard conical filter shown in FIG. 2 partially deformed on a filter support of the present invention.
Figure 4:
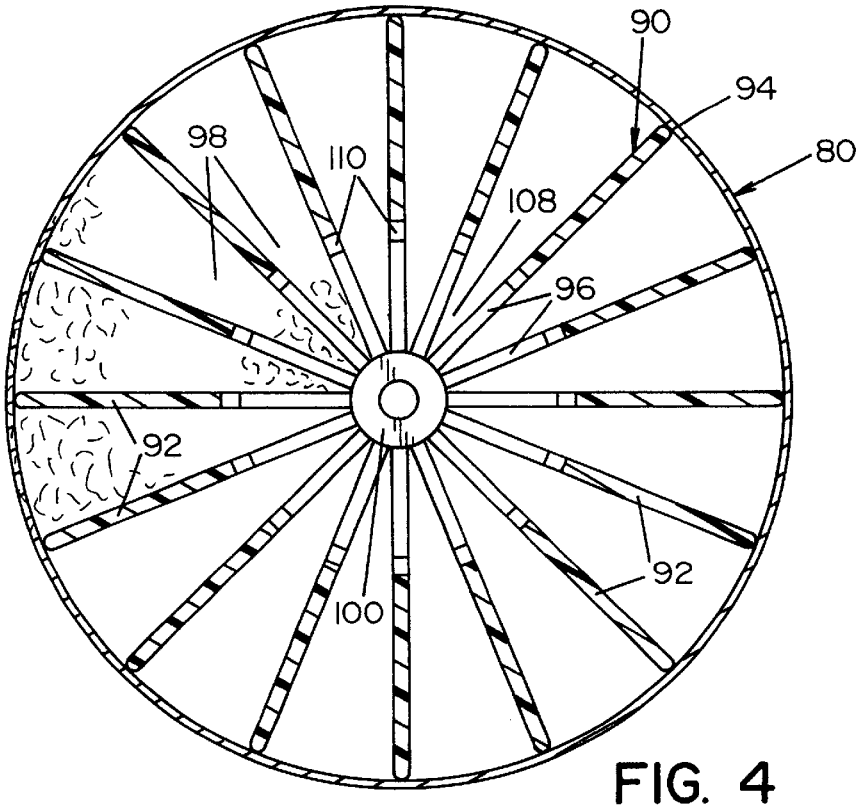
FIG. 4 is a top view of the filter support of the present invention nested in a standard conical filter wherein the filter is not subject to a vacuum.
Figure 5:
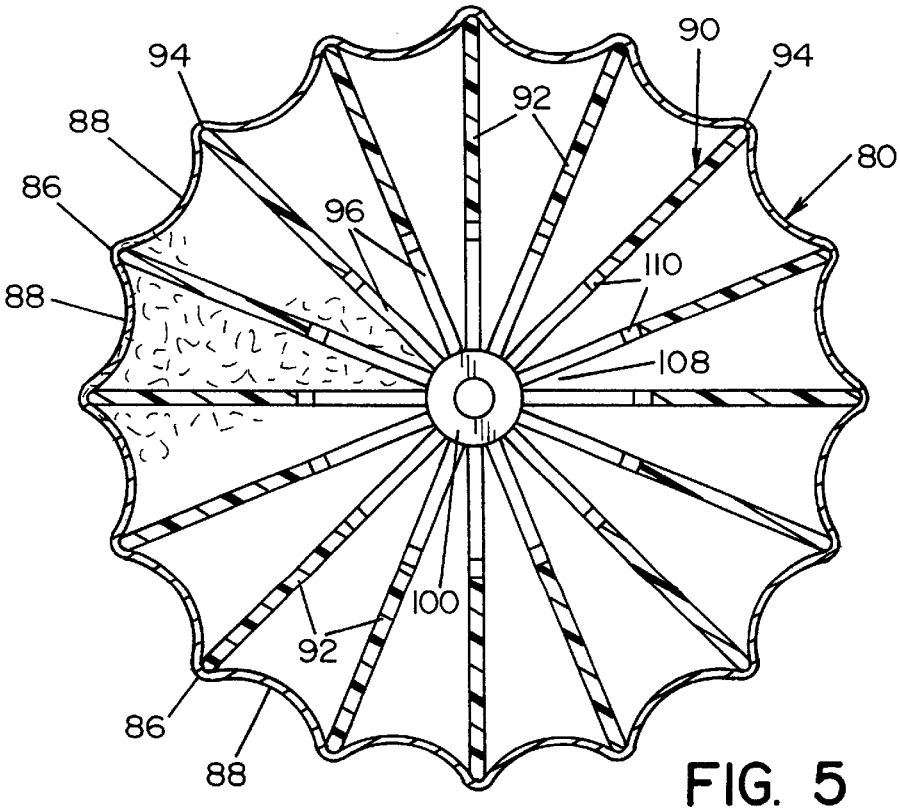
FIG. 5 is a cross-sectional view of a filter subject to a vacuum taken along line 5—5 of FIG. 1.
Figure 6:
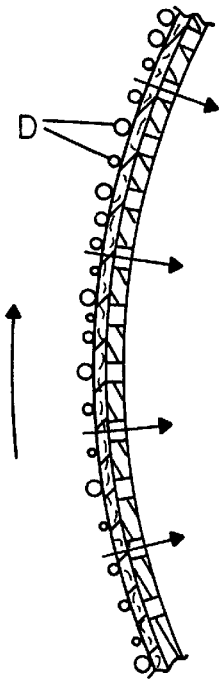
FIG. 6 (PRIOR ART)
FIG. 6 is a partial sectional view of the profile of a filter supported by a standard filter support during the filtering of particle entrained air.
Figure 7:
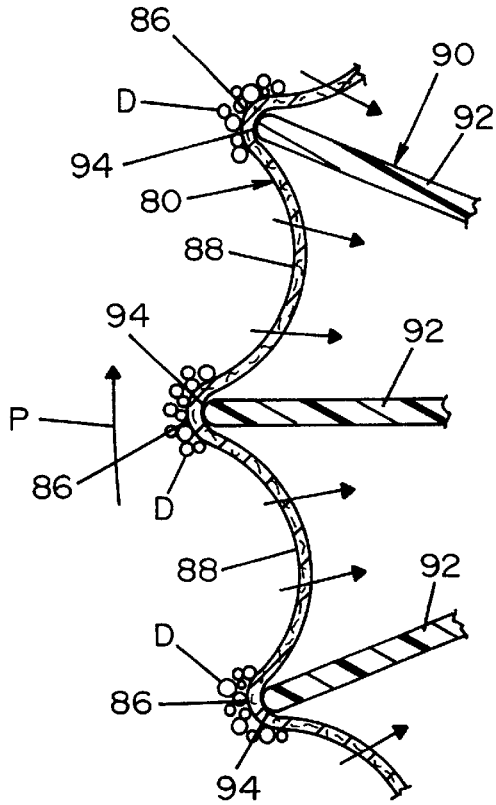
FIG. 7 is a partial sectional view of the filter in FIG. 5 supported by the filter support of the present invention during the filtering of particle entrained air.
Figure 8:
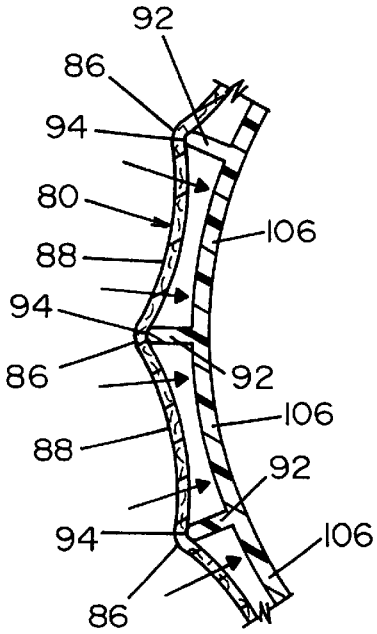
FIG. 8 is a cross-sectional view of a filter subject to a vacuum taken along line 8—8 of FIG. 1.
Figure 10:
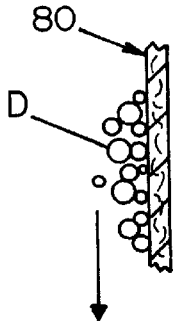
FIG. 10 is an enlarged sectional view of the filter in FIG. 9 illustrating large particles accumulating on and falling from the rib section of the filter.

The operation of the novel filtering system will now be described. As shown in FIG. 2, a conical filter 80 is used to remove particles entrained in the air. When filter 80 is positioned on filter support 90, the filter retains its conical shape as shown in FIG. 4. The shape of filter 80 is caused to become deformed when the vacuum cleaner is turned on. When motor 134 begins rotating fan blade 132, resulting is a vacuum to be formed in low velocity chamber 52, filter 80 is drawn toward filter support 90. As best shown in FIGS. 3, 5, 11, and 12, filter 80 is retained in position by the fin sections of the filter support and drawn inwardly between the regions of the fin sections thereby creating a plurality of ribs 86 and trough portions 88 on the filter. The rib and trough portions of the deformed filter enhance the life and effectiveness of the filter. Referring now to FIGS. 6–10, the advantages of the filter deformation will be described. As shown in FIG. 7, the air path about the filter is substantially tangential to the end of ribs 86. As a result, the particles in the air first contact the ribs of the filter prior to air passing through the trough portions. The ribs function are a barrier or accumulation point for the particles in the air, especially the large particles. As shown in FIG. 7, large particles D accumulate on the ribs of the filter and/or get stopped by the rib and fall to the base of the low velocity chamber. Since the ribs on the filter occupy a small area relative to the complete outer surface area of the filter, few particles can accumulate on the ribs. As a result, the large particles are knocked off or fall off the ribs and onto the base of the low velocity chamber, as shown in FIGS. 9 and 10. In addition, since the air velocity and air paths are different in the rib and trough portions, larger particles are less likely to adhere to the trough section of the filter as opposed to the ribs. Since most of the large to medium particles fall on to the low velocity chamber, or accumulate on the limited regions of the ribs, the majority of the filter is able to filter out the smaller particles in the air as the air passes through the trough portions of the filter. Prior filter profiles, as shown in FIG. 6, equally exposed the complete outer filter surface to large and small particles in the air. As a result, the filter life was significantly reduced. It has been found that the self cleaning effects of the filter due to rib and trough section filter profile increased the filter life by at least 5% and typically 10–25%.

The invention has been described with reference to a preferred embodiment and alternatives thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

Having thus defined the invention, the following is claimed:

1. A vacuum cleaner comprising a low velocity chamber with a high velocity air inlet positioned near the base of said chamber, a motor positioned in a motor housing, a blade driven by said motor to create a vacuum in said chamber to draw air upwardly in said chamber, an outlet for exhausting air from said chamber, said air flowing in a selected path from said air inlet, through said chamber and out said air exhaust outlet, the improvement comprising a filter at least partially supported on a support member positioned between said air inlet and said motor, said filter including a plurality of rib sections and trough portions between two adjacently positioned rib sections, said support member includes a plurality of fin sections and at least one opening positioned between two adjacent fin sections, said motor housing including a primary opening through which a majority of air is expelled from said motor housing into an expanding exhaust conduit having a first and second opening, said first opening connected to said primary opening in said motor housing, said second opening having a cross-sectional area greater than said first opening.

2. The improvement as defined in claim 1, wherein said expanding exhaust conduit includes an inner passageway along the longitudinal length of said conduit, said inner passageway having a height and a width, said width of said passageway increasing along at least a portion of the longitudinal length of said conduit.

3. The improvement as defined in claim 2, including an exhaust filter to filter gases from filtered air expelled through said second opening of said expanding exhaust conduit.

4. A particle filter substantially conical in shape to remove a majority of particles from air passing through the filter, said filter including a particle barrier medium to mechanically and/or electrically remove at least about 90% of the particles two microns or larger in size from said air, said filter including a plurality of ribs positioned about an outer surface of said filter and at least one trough portion positioned at least partially between two adjacent ribs and recessed from said ribs.

5. The filter as defined in claim 4, wherein said ribs are positioned substantially symmetrically about said filter.

6. The filter as defined in claim 4, wherein at least 99% of particles 2 microns or greater in size being removed.

7. The filter as defined in claim 5, wherein at least 99% of particles 2 microns or greater in size being removed.

8. A particle filter substantially conical in shape to remove a majority of particles from air passing through the filter, said filter including a particle barrier medium to mechanically and/or electrically remove at least about 90% of the particles two microns or larger in size from said air, said filter including a plurality of ribs positioned about an outer surface of said filter and at least one trough portion positioned at least partially between two adjacent ribs, said ribs are positioned substantially symmetrically about said filter, at least about 99.98% of particles about 0.1 micron or greater in size being removed from said passing air at flow rates of up to at least 60 CFM.

9. A particle filter for removing a majority of particles from air passing through the filter, said filter including a particle barrier medium to mechanically and/or electrically remove at least about 90% of the particles 2 microns or larger in size from said air, said filter including a plurality of ribs positioned about an outer surface of said filter and at least one trough portion positioned at least partially between two adjacent ribs, said filter includes a flexible material that deforms to form said ribs and said trough as air passes through said filter.

10. The filter as defined in claim 9, wherein said filter is substantially conical in shape.

11. The filter as defined in claim 9, wherein said ribs are positioned substantially symmetrically about said filter.

12. The filter as defined in claim 9, wherein at least 99% of particles 2 microns or greater in size being removed.

13. The filter as defined in claim 12, wherein at least 99% of particles 2 microns or greater in size being removed.

14. A vacuum cleaner or air cleaner comprising a reduced velocity chamber with a high velocity air inlet, a motor, a rotary blade driven by said motor to create a vacuum in said chamber, an outlet to exhaust air from said chamber, said air flowing in a selected path from said air inlet, through said chamber and a filter in said chamber, and out said air exhaust outlet, the improvement comprising a motor housing and an expanding exhaust conduit, said motor housing positioned at least partially about said motor and blade, said motor housing having an opening through which air is expelled from said motor housing, said expanding exhaust conduit having a first and second opening, said first opening connected to said opening in said motor housing, said second opening having a cross-sectional area greater than said first opening.

15. The improvement as defined in claim 14, wherein said expanding exhaust conduit includes an inner passageway along the longitudinal length of said conduit, said inner passageway having a height and a width, said width of said passageway increasing along substantially the full longitudinal length of said conduit.

16. The improvement defined in claim 14, wherein said expanding exhaust conduit includes an inner passageway along the longitudinal length of said conduit, said inner passageway having a height and a width, said height of said passageway increasing along substantially the full longitudinal length of said conduit.

17. The improvement as defined in claim 15, wherein said expanding exhaust conduit includes an inner passageway along the longitudinal length of said conduit, said inner passageway having a height and a width, said height of said passageway increasing along substantially the full longitudinal length of said conduit.

18. The improvement as defined in claim 14, including an exhaust filter to filter gases from filtered air expelled through said second opening of said expanding exhaust conduit.

19. The improvement as defined in claim 17, including an exhaust filter to filter gases from filtered air expelled through said second opening of said expanding exhaust conduit.

20. A filter support adapted to at least partially support a filter, said filter support comprising a plurality of fin sections, at least one opening at least partially positioned between two adjacent fin sections, a rigidity ring, and rigidity panel, at least two of said fin sections having a front face, a rear face and two side faces extending between said front and rear face, said side faces having a maximum width that is greater than a maximum width of said face, said rigidity ring connecting a plurality of said fin sections together, said rigidity panel at least partially positioned between end of said fins and connecting a plurality of said fin sections together.

21. The filter support as defined in claim 20, wherein a plurality of side rear faces form a nest for a secondary filter.

22. The filter support as defined in claim 20, wherein said filter supports has a substantially conical shape.

23. The filter support member as defined in claim 20, wherein a plurality of said fin sections are positioned substantially symmetrically about said filter support.

24. A filter support adapted to at least partially support a filter, said filter support comprising a plurality of fin sections and at least one opening at least partially positioned between two adjacent fin sections, at least two of said fin sections having a front face, a rear face and two side faces extending between said front and rear face, said side faces having a maximum width that is greater than a maximum width of said face, said two side faces having a width that varies along at least a portion of a height of said filter support.

25. The filter support as defined in claim 24, wherein a plurality of side rear faces form a nest for a secondary filter.

26. The filter support as defined in claim 25, wherein said nest has an at least partially conical shape.

27. The filter support as defined in claim 26, wherein said filter support has a substantially conical shape.

28. The filter support member as defined in claim 27, wherein a plurality of said fin sections are positioned substantially symmetrically about said filter support.

29. A vacuum cleaner comprising a low velocity chamber with a high velocity air inlet, a motor, a blade driven by said motor to create a vacuum in said chamber, an outlet for exhausting air from said chamber, said air flowing in a selected path from said air inlet, through said chamber and out said air exhaust outlet, the improvement comprising a filter that is at least partially supported on a support member positioned between said air inlet and said motor, said filter including a plurality of rib sections and trough portions between two adjacently positioned rib sections, said support member includes a plurality of fin sections and at least one opening positioned between two adjacent fin sections, said filter at least partially supported by at least one of said plurality of fin sections as air passes through said filter.

30. The improvement as defined in claim 29, wherein said filter at least partially removes gases in the air.

31. The improvement as defined in claim 29, wherein said filter at least partially removes gases in the air.

32. The improvement as defined in claim 29, wherein said support member includes a portion that has a shape and size that is at least partially similar to a shape and size of said filter.

33. The improvement as defined in claim 31, wherein said support member includes a portion that has a shape and size that is at least partially similar to a shape and size of said filter.

34. The improvement as defined in claim 29, wherein said support member includes a portion that has a shape and size that is smaller than said filter.

35. The improvement as defined in claim 31, wherein said support member includes a portion that has a shape and size that is smaller than said filter.

36. The improvement as defined in claim 34, wherein said filter is at least partially flexible and adapted to at least partially deform on said support member thereby forming a plurality of said rib sections and at least one of said through portions when said vacuum is created in said chamber.

37. The improvement as defined in claim 35, wherein said filter is at least partially flexible and adapted to at least partially deform on said support member thereby forming a plurality of said rib sections and at least one of said through portions when said vacuum is created in said chamber.

38. The improvement as defined in claim 33, wherein said filter is at least partially flexible and adapted to at least partially deform on said support member thereby forming a plurality of said rib sections and at least one of said through portions when said vacuum is created in said chamber.

39. The improvement as defined in claim 29, wherein said low velocity chamber is contained in a removable canister.

40. The improvement as defined in claim 37, wherein said low velocity chamber is contained in a removable canister.

41. The improvement as defined in claim 38, wherein said low velocity chamber is contained in a removable canister.

42. The improvement as defined in claim 39, wherein said removable canister is removably positioned on a base of said vacuum cleaner.

43. The improvement as defined in claim 29, including a motor housing and an expanding exhaust conduit, said motor housing positioned at least partially about said motor and said blade, said motor housing having an opening through which air is expelled from said motor housing, said expanding exhaust conduit having a first and second opening, said first opening connected to said opening in said motor housing, said second opening having a cross-sectional area greater than said first opening.

44. The improvement as defined in claim 40, including a motor housing and an expanding exhaust conduit, said motor housing positioned at least partially about said motor and said blade, said motor housing having an opening through which air is expelled from said motor housing, said expanding exhaust conduit having a first and second opening, said first opening connected to said opening in said motor housing, said second opening having a cross-sectional area greater than said first opening.

45. The improvement as defined in claim 41, including a motor housing and an expanding exhaust conduit, said motor housing positioned at least partially about said motor and said blade, said motor housing having an opening through which air is expelled from said motor housing, said expanding exhaust conduit having a first and second opening, said first opening connected to said opening in said motor housing, said second opening having a cross-sectional area greater than said first opening.

46. The improvement as defined in claim 43, wherein said expanding exhaust conduit includes an inner passageway along the longitudinal length of said conduit, said inner passageway having a height and a width, said width of said passageway increasing along at least a portion of the longitudinal length of said conduit.

47. The improvement as defined in claim 43, wherein said expanding exhaust conduit includes an inner passageway along the longitudinal length of said conduit, said inner passageway having a height and a width, said height of said passageway increasing along at least a portion of the longitudinal length of said conduit.

48. The improvement as defined in claim 46, wherein said expanding exhaust conduit includes an inner passageway along the longitudinal length of said conduit, said inner passageway having a height and a width, said height of said passageway increasing along at least a portion of the longitudinal length of said conduit.

49. The improvement as defined in claim 43, including an exhaust filter to filter gases from filtered air expelled through said second opening of said expanding exhaust conduit.

50. The improvement as defined in claim 48, including an exhaust filter to filter gases from filtered air expelled through said second opening of said expanding exhaust conduit.

51. The improvement as defined in claim 29, wherein said particle filter is at least partially positioned in said low velocity chamber.

52. The improvement as defined in claim 29, wherein at least a portion of said filter has a substantially conical shape.

53. The improvement as defined in claim 44, wherein at least a portion of said filter has a substantially conical shape.

54. The improvement as defined in claim 45, wherein at least a portion of said filter has a substantially conical shape.

55. The improvement as defined in claim 29, wherein said support member has a partially conical shape.

56. A The improvement as defined in claim 53, wherein said support member has a partially conical shape.

57. The improvement as defined in claim 54, wherein said support member has a partially conical shape.

58. A method of cleaning air by use of a canister type vacuum cleaner including the steps of:

(a) drawing air through a high velocity air inlet into a low velocity chamber;

(b) centrifuging the air in the low velocity chamber to at least partially remove solid particles;

(c) passing said air through a filter system to further remove particles from said air, said filter system including a particle filter and a filter support, said filter support including a plurality of fin sections and at least one opening positioned between two adjacent fins;

(d) passing said filtered air through said particle filter to remove at least about 90% of said particles greater than about 2 microns in said air;

(e) directing said filtered air through said at least one opening in said filter support and past said motor and out an air outlet; and, at least partially deforming said filter on said filter support to form at least two ribs and at least one trough portion between said two ribs as said air is drawn through said filter.

59. The method as defined in claim 58, wherein said filter removes at least about 99% of said particles greater than about 2 microns in said air.

60. The method as defined in claim 59, including the step of at least partially removing gases from said air.

61. The method as defined in claim 59, wherein at least a portion of said particle filter has a substantially conical shape.

62. The method as defined in claim 60, wherein at least a portion of said particle filter has a substantially conical shape.

63. A method of cleaning air by use of a canister type vacuum cleaner including the steps of:

(a) drawing air through a high velocity air inlet into a low velocity chamber;

(b) centrifuging the air in the low velocity chamber to at least partially remove solid particles;

(c) passing said air through a filter system to further remove particles from said air, said filter system including a particle filter and a filter support, said filter support including a plurality of fin sections and at least one opening positioned between two adjacent fins;

(d) passing said filtered air through said particle filter to remove at least about 90% of said particles greater than about 2 microns in said air;

(e) directing said filtered air through said at least one opening in said filter support and past said motor and out an air outlet; and, at least a portion of said particle filter has a substantially conical shape.

64. A particle filter having a substantially conical shape to at least partially remove particles from air passing through the filter that are greater than about 2 microns, said filter including a particle barrier medium to mechanically and/or electrically remove at least about 90% of said particles that are two microns or larger in size from said air, said filter including a plurality of ribs positioned about an outer surface of said filter, said filter including a plurality of trough portions, at least one of said plurality of trough portions being positioned at least partially between two adjacent ribs, and said filter includes a flexible material that deforms to form said ribs and said plurality of trough portions as air passes through said filter.

65. The filter as defined in claim 64, wherein said ribs are positioned substantially symmetrically about said filter.

66. The filter as defined in claim 65, wherein said trough portions are positioned substantially symmetrically about said filter.

67. A combination of a filter and a filter support member wherein the filter is adapted to be at least partially supported on a filter support member, said filter including a plurality of rib sections and at least one trough portion positioned between two adjacently positioned rib sections, said filter support member includes a plurality of fin sections and at least one opening positioned between two adjacent fin sections, said support member and said filter having an at least partial conical shape, and said filter includes a flexible material that at least partially deforms to form at least one of said rib sections and at least one of said trough portions as air passes through said filter.

68. A combination of a filter and a filter support member wherein the filter is adapted to be at least partially supported on a filter support member, said filter including a plurality of rib sections and at least one trough portion positioned between two adjacently positioned rib sections, said filter support member includes a plurality of fin sections and at least one opening positioned between two adjacent fin sections, said support member and said filter having an at least partial conical shape, and said filter includes a flexible material that at least partially deforms to form at least one of said rib sections and at least one of said trough portions as air passes through said filter, said filter removes at least about 90% of particles greater than about 2 microns, and said filter at least partially removes gases in the air.

69. The combination of a filter and a filter support member as defined in claim 68, wherein said support member has a shape and size that is smaller than said filter.

70. The combination of a filter and a filter support member as defined in claim 69, wherein said rib sections and said trough portions are positioned substantially symmetrically about said filter.

* * * * *